US012044029B2

(12) United States Patent
Kim

(10) Patent No.: US 12,044,029 B2
(45) Date of Patent: Jul. 23, 2024

(54) ANGLE VARIABLE MULTI-STAGE SUNSHADE DEVICE

(71) Applicant: Min So Kim, Changwon-si (KR)

(72) Inventor: Min So Kim, Changwon-si (KR)

( * ) Notice: Subject to any disclaimer, the term of this patent is extended or adjusted under 35 U.S.C. 154(b) by 209 days.

(21) Appl. No.: 17/572,629

(22) Filed: Jan. 11, 2022

(65) Prior Publication Data

US 2022/0341201 A1 Oct. 27, 2022

(30) Foreign Application Priority Data

Apr. 20, 2021 (KR) ..... 10-2021-0050912
Jun. 15, 2021 (KR) ..... 10-2021-0077452

(51) Int. Cl.

| | |
|---|---|
| ***E04F 10/04*** | (2006.01) |
| ***E04H 15/38*** | (2006.01) |
| ***E04H 15/48*** | (2006.01) |
| ***E04H 15/58*** | (2006.01) |

(52) U.S. Cl.
CPC ..... *E04H 15/58* (2013.01); *E04F 10/04* (2013.01); *E04H 15/38* (2013.01); *E04H 15/48* (2013.01)

(58) Field of Classification Search
CPC ..... E04F 10/04
See application file for complete search history.

(56) References Cited

U.S. PATENT DOCUMENTS 707,483 A * 8/1902 Winants ..... E04H 15/38 135/132
903,994 A * 11/1908 Levin ..... E04H 15/00 135/96
2,036,033 A * 3/1936 Fisher ..... E04H 15/56 5/418
2,877,722 A * 3/1959 Peat ..... B61D 39/002 135/137
3,470,659 A * 10/1969 De Koning ..... E04H 15/38 52/63
4,343,322 A * 8/1982 Fiddler ..... E04H 15/003 135/133
4,355,650 A * 10/1982 Beaudry ..... E04H 15/38 135/130
4,469,114 A * 9/1984 Kelley ..... E04H 15/38 135/133

(Continued)

FOREIGN PATENT DOCUMENTS

EP 2098663 A2 * 9/2009 ..... A47C 1/14
KR 960005939 Y1 * 7/1996

(Continued)

*Primary Examiner* — David R Dunn
*Assistant Examiner* — Danielle Jackson
(74) *Attorney, Agent, or Firm* — Revolution IP, PLLC

(57) ABSTRACT

An angle variable multi-stage sunshade device, includes: a support member consisting of a 1st support installed on one side and a 2nd support installed to be spaced apart by a predetermined distance from the 1st support; and a sunshade member consisting of multiple sunshade units rotatably installed on the 1st support and the 2nd support, respectively. The device allows the user to easily install the sunshade that covers the upper side of the table by deploying each sunshade unit while adjusting the angle of the multiple sunshades individually in a desired angle and direction according to the altitude of the sun for each season.

7 Claims, 24 Drawing Sheets

(56) References Cited

U.S. PATENT DOCUMENTS

| | | | | |
|---|---|---|---|---|
| 4,716,919 | A * | 1/1988 | Griffin | E04H 15/48 135/901 |
| 5,085,240 | A * | 2/1992 | Littledeer | E04H 15/38 135/132 |
| 5,740,828 | A * | 4/1998 | Evans | E04H 6/04 135/132 |
| 7,591,032 | B2 * | 9/2009 | Harrison | E04H 15/38 5/8 |
| 9,777,505 | B2 * | 10/2017 | Sprung | E04H 15/644 |
| 11,433,974 | B2 * | 9/2022 | Basta | B63C 5/00 |
| 2007/0295380 | A1 * | 12/2007 | Glaeser | E04H 15/38 135/133 |
| 2008/0202573 | A1 * | 8/2008 | Corbiere | E04H 15/02 135/96 |

FOREIGN PATENT DOCUMENTS

| | | | |
|---|---|---|---|
| KR | 101013609 | B1 * | 2/2011 |
| KR | 20-2013-0001790 | U | 3/2013 |
| KR | 10-2016-0012418 | A | 2/2016 |
| KR | 10-1989051 | B1 | 6/2019 |

* cited by examiner

ANGLE VARIABLE MULTI-STAGE SUNSHADE DEVICE

TECHNICAL FIELD

The present invention relates to an angle variable multi-stage sunshade device, and more particularly, to an angle variable multi-stage sunshade device in which sunshades are installed in multiple stages and can be deployed at a desired angle and direction.

BACKGROUND ART

In general, sunshade devices such as curtains, blinds, and roll screens are installed on windows or doorways of buildings to control light coming into the room from the outside.

These sunshade devices have not only the above-mentioned purpose, but also the purpose of blocking external gaze or blocking cold and heat.

They also aim to enhance the aesthetics of the interior by changing the hard and cold feeling of walls or glass to soft and warm.

On the other hand, according to the opening and closing operation, the sunshade devices are divided into a type that opens and closes horizontally and a type that opens and closes vertically.

But that's just a general distinction. In reality, a screen or blind such as roll blind, vertical blind, screen blind, roman shade and combi screen is pulled in one direction by a driving wire such as a ball chain connected to a sprocket installed on one side of the bracket so that a sunshade descends as it unwinds from the winding bar, which is fixed at a certain position to block the light coming through the window.

However, the aforementioned various blinds contain a risk that children may trip over the driving wire provided to operate the sunshade vertically or horizontally, or even suffocate due to their neck being wound around the driving wire.

In fact, in the United States recently, children often choked on the driving wire to suffocation or death, resulting in recalls of 50 million previously released blind products.

In order to respond to this problem, Korea recently announced the revision of the enforcement rules of the "Quality Management and Industrial Product Safety Management Act" to designate the blind as a safety management item, and plans to prepare the safety standards for the driving wire accordingly.

Meanwhile, when the sunshade is oscillated by an indoor air blower or air flowing in from the outside while the window frame is open, a weight member provided, at the bottom of the sunshade, to spread the sunshade in the gravitational direction collides with the window frame, generating noise and being unable to effectively block light coming from the outside.

Moreover, when the weight member collides with an object such as furniture adjacent to the window frame, it may be damaged.

The sunshade device has the effect of blocking direct sunlight or rainwater on the entrance or wall of a building, making it easier to go and out, or in the case of a store, it not only protects the products placed on it but also expands the area of the store.

Such a sunshade device is usually used to fix a sunshade, but in the case of a fixed configuration, the sunshade spread outward may collide with a vehicle or be damaged if there is a lot of wind, snow, or rain.

For this reason, many recent devices adopt a configuration in which the rotating shaft around which the sunshade is wound is installed on the wall of the building and a link device that moves the end of the sunshade to spread the sunshade. However, its foldable arm that spreads the sunshade has a limit in length, so if it is stretched to an excessive length, it will be bent, making it impossible to install a wide sunshade. Moreover, since the sunshade is supported by the arms installed symmetrically on both sides, the arm may be damaged due to weak resistance to strong winds, heavy snow, and heavy rain.

For example, Patent Document 1 below discloses a "sunshade device equipped with a safety device".

A sunshade device equipped with a safety device according to Patent Document 1 includes: a winding bar around which a sunshade is wound so as to move up and down while rotating, and of which one end is connected to a rotational driving unit equipped with a first sprocket; a driving wire composed of a ball chain, of which the upper end is wound and coupled to the outer periphery of the first sprocket, and which is rotationally towed to provide rotational force to the winding bar; a 2nd sprocket unit in which the lower end of the driving wire is wound and coupled to the outer periphery thereof; and a fixed case unit that rotatably supports the 2nd sprocket and is fixed to an external structure.

The fixed case unit includes: a front case in which multiple coupling step grooves are formed along the edge; a rear case provided with coupling protrusions protruding at a position opposite to the coupling step grooves and elastically inserted into the coupling step grooves and fixed thereto; a through coupling part that passes through the 2nd sprocket unit and is coupled to the front case and the rear case to support rotation; and a safety bracket connected to the front case and fixed to the external structure at a position corresponding to the length of the driving wire.

The following Patent Document 2 discloses a "shading module for multi-step seats".

The shading module for multi-step seats according to the following Patent Document 2 is installed in the multi-step seats—of which use state is implemented by the relative withdrawal of multiple stages including the 1st grandstand and the 2nd grandstand that is the upper stage of the 1st grandstand, and of which storage state is implemented by their relative hiding—to be connected to and support a blocking unit that provides a blocking area in which external factors can be blocked so that at least a part of the blocking unit can be located at a predetermined height with respect to the multi-step seats.

The shading module for multi-step seats includes: an external force applying unit that applies an external force to the blocking unit so as to automatically deform the blocking area in response to a change in state of the multi-step seats from the storage state to the use state; a blocking limiting unit connected to the external force applying unit to limit the position of the blocking unit so that the blocking unit is spaced downwardly from a portion connected to the external force applying unit to prevent the blocking unit from sagging beyond a predetermined distance; and a blocking support unit connected to the external force applying unit and supporting the blocking limiting unit.

The external force applying unit includes a 1st external force applying unit connected to the 1st grandstand and a 2nd external force applying unit connected to the 2nd grandstand, wherein the 1st external force applying unit is connected to the side of the 1st grandstand in a forward direction when the multi-step seats are in a storage state so that it contacts the side of the 1st grandstand and the side of the 2nd grandstand in the forward direction of the 1st external force applying unit.

PRIOR ART DOCUMENTS

Patent Documents (Patent Document 1) Korea Patent Publication No. 10-2016-0012418

(Patent Document 2) Korea Patent Registration No. 10-1989051

(Patent Document 3) Korea Utility Model Publication No. 20-2013-0001790

SUMMARY OF INVENTION

Technical Problem

The present invention aims to solve the above problems by providing an angle variable multi-stage sunshade device capable of folding or unfolding multiple sunshades in multiple stages and deploying the sunshade at a user's desired angle.

The present invention also aims to provide an angle variable multi-stage sunshade device capable of adjusting the angle of the sunshade using a gas spring and wire tension while a multi-stage sunshade is unfolded.

Another object of the present invention is to provide an angle variable multi-stage sunshade device that allows to install the sunshade easily and stably by the tension of the wire and the turnbuckle and to fold and store the sunshade in multiple stages by dismantling the turnbuckle in case of a natural disaster such as a typhoon.

Another object of the present invention is to provide an angle variable multi-stage sunshade device capable of preventing movement and shaking of the center of the sunshade during sunshade rotation by using support members in different directions at the same time, and allowing rotation at a fixed position.

Another object of the present invention is to provide an angle variable multi-stage sunshade device capable of stably maintaining a sunshade deployed state by using a wire.

Solution to Problem

The angle variable multi-stage sunshade device according to an embodiment of the present invention may comprise: a base member with multiple frames formed radially; a support member to be seated at a predetermined distance from the upper end of the frame, and consisting of a 1st support and a 2nd support; a baseplate member to be installed on the upper surface of the first support, and formed in a flat plate shape; a rotary frame member to be installed on the side of the first supporting part, and comprising a combination of a circular frame formed in a circular ring shape, multiple bent frames, and multiple fixing parts; a rotary support member to be fixed to the bent frame; a sunshade member to be rotatably installed to the rotary support member; and a deployment control member to be installed to control the unfolding position of the sunshade member and the interval at which the sunshade member is unfolded.

In the angle variable multi-stage sunshade device according to an embodiment of the present invention, the 1st support may comprise: a roller base to be provided in a truncated pyramid shape and attached at a preset distance from the upper end of the frame; a U-shaped roller frame consisting of a horizontal frame and 1st and 2nd vertical frames that are provided vertically at both ends of the horizontal frame, wherein the 1st vertical frame is coupled to the upper surface of the roller base; and a roller to be provided in the space between the 1st vertical frame and the 2nd vertical frame. The 2nd support may comprise: a roller frame consisting of a horizontal frame and 1st and 2nd vertical frames that are provided vertically at both ends of the horizontal frame, wherein the horizontal frame is coupled to the upper end of the frame; and a roller to be provided in the space between the 1st vertical frame and the 2nd vertical frame.

In the angle variable multi-stage sunshade device according to an embodiment of the present invention, the rotary support member may comprise: a 1st rotary bracket to which the sunshade member is rotatably coupled; and a 2nd rotary bracket to which the 1st rotary bracket is rotatably coupled.

In the angle variable multi-stage sunshade device according to an embodiment of the present invention, the sunshade member may comprise: a 1st sunshade formed in a radial arc shape to form a shading space; a 2nd sunshade to be provided adjacent to the 1st sunshade, and formed in a radial arc shape to form a shading space; a 3rd sunshade to be provided adjacent to the 2nd sunshade, and formed in a radial arc shape to form a shading space; a 1st rotary frame that is rotatably coupled to the 1st rotary bracket, and fixes one end of the 1st sunshade; a 2nd rotary frame that is rotatably coupled to the 1st rotary bracket, and fixes the other end of the 1st sunshade and one end of the 2nd sunshade; a 3rd rotary frame that is fixedly coupled to the 1st rotary bracket, and fixes the other end of the 2nd sunshade and one end of the 3rd sunshade; and a 4th rotary frame that is rotatably coupled to the 1st rotary bracket, and fixes the other end of the 3rd sunshade.

In the angle variable multi-stage sunshade device according to an embodiment of the present invention, the deployment control member may comprise: a 1st wire with one end fixed to the 1st rotary frame and the other end fixed to the turnbuckle; a 2nd wire that passes through multiple fixing parts, with one end fixed to the turnbuckle and the other end fixed to the 4th rotary frame; and a 3rd wire that is fixed to the 1st rotary frame, the 2nd rotary frame, the 3rd rotary frame and the 4th rotary frame, and connects one end of the 1st wire to the other end of the 2nd wire.

The angle variable multi-stage sunshade device according to an embodiment of the present invention may further comprise a fence member to be installed along the circumference of the baseplate member.

In addition, the angle variable multi-stage sunshade device according to an embodiment of the present invention may comprise: a support member (1110) consisting of a 1st support (1111) installed on one side and a 2nd support (1112) installed to be spaced apart from the 1st support (1111) by a predetermined distance; a sunshade member (1130) comprising multiple sunshade units (131, 135, 141) that are rotatably installed on the 1st support (1111) and the 2nd support (1112), respectively; and a deployment control member (1170) that is installed to adjust the unfolding position and interval of the multiple sunshade members (1130), wherein the support member (1110) comprises a support (1113) formed at a predetermined height and a rotary bracket (1114) installed on the upper surface of the support (1113), and to which multiple sunshade units (131, 135, 141) are rotatably coupled, while the sunshade member (1130) comprises a 1st sunshade unit (1131) which is rotatably coupled to the support member (1110), and formed in a radial arc shape to form a shading space; a 2nd sunshade unit (1135) which is rotatably coupled to the support member (1110), and formed in a radial arc shape to form a shading space; and a 3rd sunshade unit (1141) which is rotatably coupled to the support member (1110), and formed in a radial arc shape to form a shading space. In addition, the 1st sunshade frame (1132) for fixing one end of the 1st sunshade (1134) is fixed to the 1st sunshade unit (1131), a 1st rotary frame (1133) rotatably coupled to a rotary bracket (1114) is formed on both sides of the 1st sunshade frame (1132), the 2nd sunshade unit (1135) comprises a 2nd sunshade frame (1136) for fixing one end of the 2nd sunshade (1138), the 2nd sunshade frame (1136) is fixed to one end of the 1st sunshade (1134) and one end of the 2nd sunshade (1138), a 2nd rotary frame (1137) rotatably coupled to a rotary bracket (1114), respectively, is formed on both sides of the 2nd sunshade frame (1136), the 3rd sunshade unit (1141) comprises a 3rd sunshade frame (1142) and a 4th sunshade frame (1143) for fixing the 3rd sunshade (1145). Here, a 3rd rotary frame (1144) rotatably coupled to the rotary bracket (1114) is formed on both sides of the 3rd sunshade frame (1142), a 4th rotary frame (1146) rotatably coupled to the rotary bracket (1114) is formed on both sides of the 4th sunshade frame (1143), and the 1st rotary frame (1133), the 2nd rotary frame (1137), the 3rd rotary frame (1144) and the 4th rotary frame (1146) are coupled with a predetermined distance from one side to the other side on the axis of the rotary bracket (1114) to avoid interference with each rotation. When the 1st, 2nd, and 3rd sunshade units (1131, 1135, 1141) are folded to the maximum, the lines extending from the 1st rotary frame (1133), the 2nd rotary frame (1137), the 3rd rotary frame (1144) and the 4th rotary frame (1146) to the 1st sunshade frame (1132), the 2nd sunshade frame (1136), the 3rd sunshade frame (1142) and the 4th sunshade frame (1143), respectively, form parallel lines on one surface in three dimensions, and may be superimposed on a straight line on the other surface in three dimensions.

Beneficial Effects

As described above, the angle variable multi-stage sunshade device according to the present invention allows the user to easily install the sunshade that covers the upper side of the table by deploying each sunshade unit in a desired angle and direction while adjusting the angle of the multiple sunshades individually according to the altitude of the sun for each season.

The angle variable multi-stage sunshade device according to the present invention allows to form a comfortable shading space by adjusting the desired angle and direction of the sunshade according to the wind direction and the altitude and direction of the sun, to easily and stably form a sunshade space by binding the wires and adjusting the tension of the turnbuckles, to keep the sunshade in a state of tension without being folded by the tension of the wire when the sunshade is deployed, and to easily and safely store the sunshade by folding it in multiple stages by releasing the turnbuckle in case of a natural disaster such as a typhoon.

In addition, according to the present invention, different types of support members are used at the same time, thereby preventing the movement and shaking of the center of the sunshade when rotating the sunshade, while enabling rotation at a fixed position.

In addition, according to the present invention, the wire is used to stably maintain the sunshade deployed state.

BEST MODE FOR CARRYING OUT THE INVENTION

Hereinafter, embodiments of the present invention will be described in detail with reference to the accompanying drawings so that those of ordinary skill in the art can easily carry out the present invention.

However, the embodiments according to the present invention are only for structural or functional description, so the scope of the present invention should not be construed as being limited by the embodiment described in the text.

For example, since the embodiments may be variously changed and may have various forms, it should be understood that the scope of the present invention includes equivalents capable of realizing the technical idea.

In addition, since the object or effect presented in the present invention does not mean that a specific embodiment should include all of them or only such effects, it should not be understood that the scope of the present invention is limited thereby.

In the present specification, the present embodiment is provided to make the disclosure of the present invention complete, and to fully inform the scope of the invention to those of ordinary skill in the art to which the present invention pertains. In addition, the invention is only defined by the scope of the claims.

Accordingly, in some embodiments, well-known components, well-known operations, and well-known techniques have not been specifically described in order to avoid obscuring the present invention.

Meanwhile, the meaning of the terms described in the present invention is not limited to the dictionary definition, and should be understood as follows.

Unless defined otherwise, all terms used herein have the same meaning as commonly understood by those of ordinary skill in the art to which this invention belongs.

Terms defined in the dictionary should be interpreted as being consistent with the meaning in the context of the related art, and cannot be interpreted as having an ideal or excessively formal meaning unless explicitly defined in the present invention.

Hereinafter, the angle variable multi-stage sunshade device according to a preferred embodiment of the present invention will be described in detail with reference to the accompanying drawings.

Embodiment 1

Figure 1:
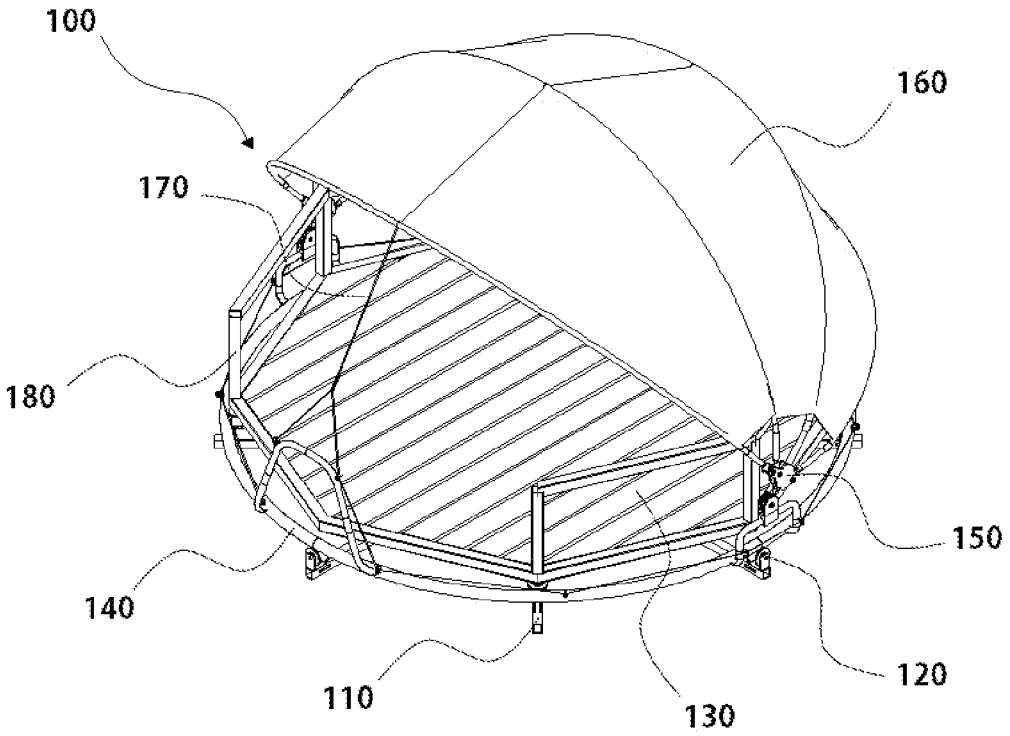
FIG. 1 is a perspective view showing an angle variable multi-stage sunshade device according to an embodiment of the present invention.
Figure 2:
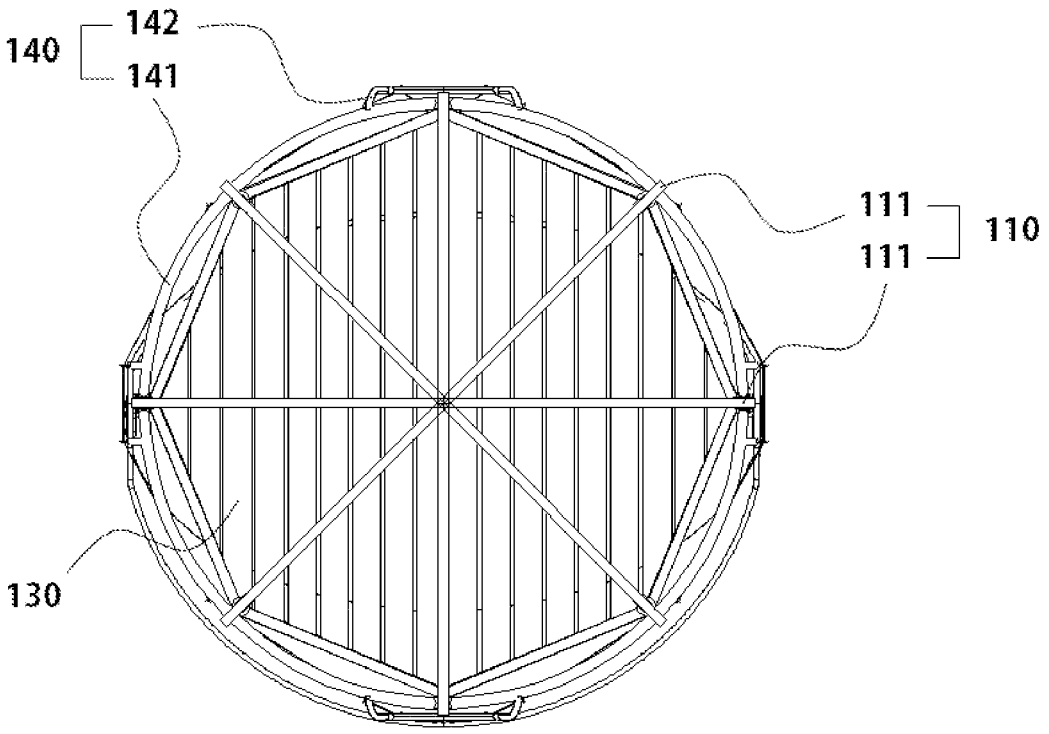
FIG. 2 is a bottom view showing an angle variable multi-stage sunshade device according to an embodiment of the present invention.

FIG. 1 is a perspective view showing an angle variable multi-stage sunshade device (100) according to an embodiment of the present invention, and FIG. 2 is a bottom view.

Referring to FIG. 1 and FIG. 2, the angle variable multi-stage sunshade device (100) according to an embodiment of the present invention comprises a base member (110), a support member (120), a baseplate member (130), a rotary frame member (140), a rotary support member (150), a sunshade member (160) and a deployment control member (170).

The base member (110) may be formed of multiple frames (111) forming a radial shape, and may be installed on the ground.

The support member (120) is seated at a predetermined distance from the upper end of the frame (111), and may comprise a 1st support (121) and a 2nd support (122). The support member (120) may be provided in such a way that the 1st support (121) and the 2nd support (122) are alternately seated on each of the multiple frames (111).

Figure 3:
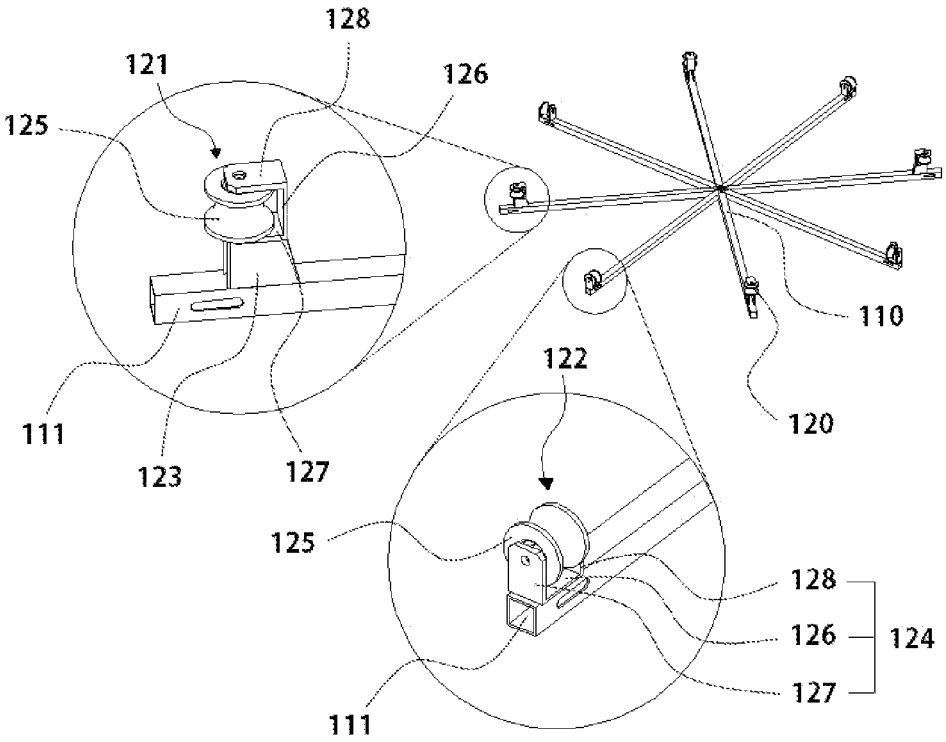
FIG. 3 is a view showing a base member and a support member according to an embodiment of the present invention.
Figure 4:
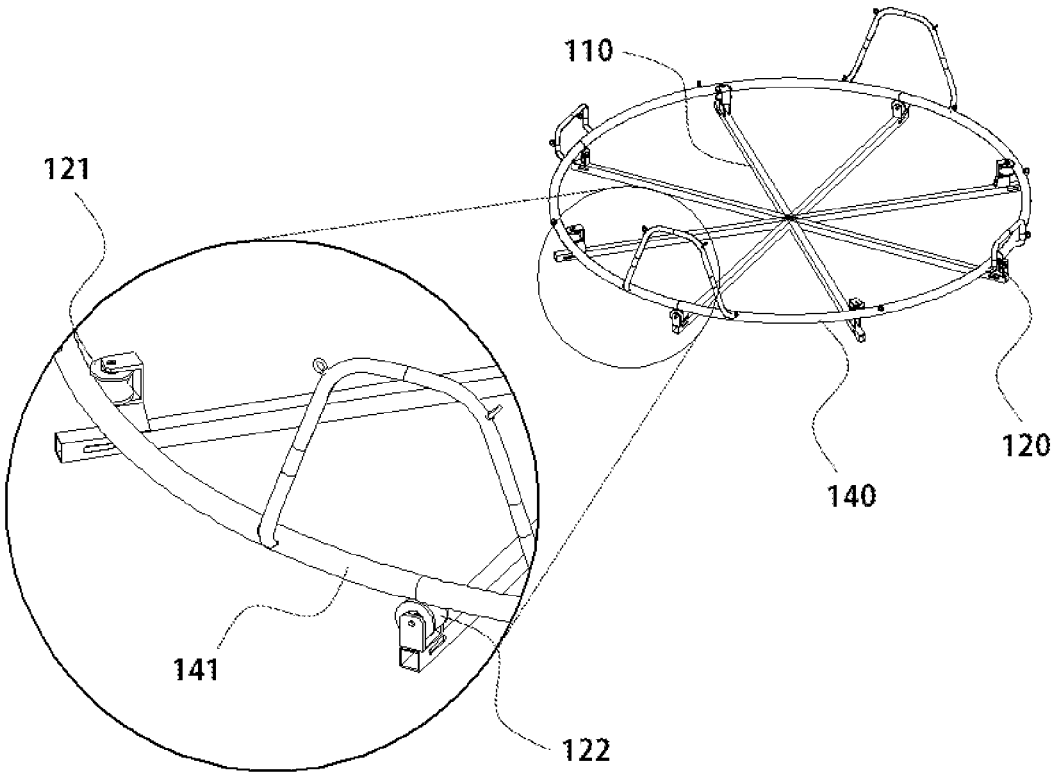
FIG. 4 is a view showing a base member, a support member and a rotary frame member according to an embodiment of the present invention.

FIGS. 3 and 4 show the 1st support (121) and the 2nd support (122) in more detail.

FIG. 3 is a view showing a base member (110) and a support member (120) according to an embodiment of the present invention, and FIG. 4 is a view showing a base member (110), a support member (120) and a rotary frame member (140).

Referring to FIG. 3, the 1st support (121) according to an embodiment of the present invention may comprise a roller base (123), a roller frame (124), and a roller (125).

The roller base 123 is provided in a truncated pyramid shape and may be attached to be spaced apart from the upper end of the frame (111) by a predetermined distance. The roller base (123) may be provided in various shapes having a height other than the truncated pyramid shape.

The roller frame (124) consists of a horizontal frame (126), a 1st vertical frame (127) and a 2nd vertical frame (128) provided vertically at both ends of the horizontal frame (126), wherein the 1st vertical frame (127) may be formed in a "U" shape that is contact-coupled to the upper surface of the roller base (123).

The roller (125) may be provided in a space between the 1st vertical frame (127) and the 2nd vertical frame (128).

Meanwhile, the 2nd support (122) according to an embodiment of the present invention may also comprise a roller frame (124) and a roller (125).

Unlike the roller frame (124) of the 1st support (121), the roller frame (124) of the 2nd support (122) may have the horizontal frame (126) coupled to the upper end of the frame (111).

That is, when the 2nd support (122) is turned by 90° and attached on the roller base (123), it may have the same shape as the 1st support (121).

The 1st support (121) and the 2nd support (122) may support the rotation of the rotary frame member (140) as shown in FIG. 4.

In addition, the support member (120) may comprise a geared motor (129). The geared motor (129) described above means a combination of the electric motor (129A) and the reduction gear device (129B).

Figure 13:
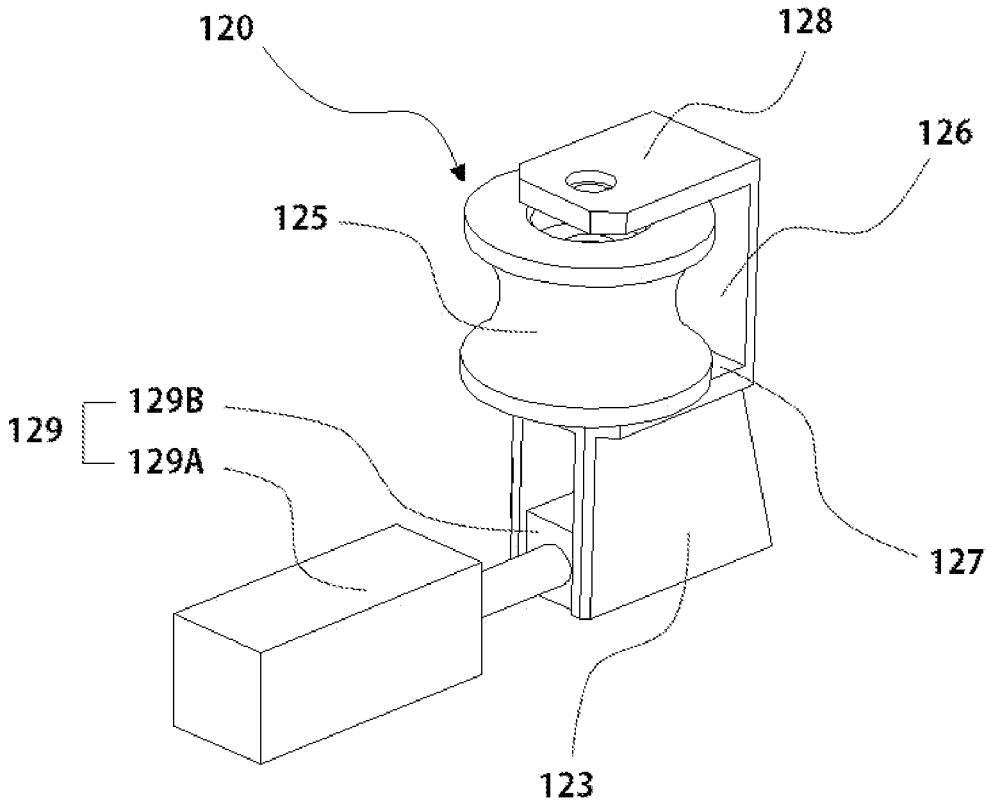
FIG. 13 is a view showing a support member according to another embodiment of the present invention.

FIG. 13 shows the configuration of the geared motor (129) in detail.

FIG. 13 is a view showing the support member (120) according to another embodiment of the present invention.

Referring to FIG. 13, the geared motor (129) may be provided on the side of the support member (120). The geared motor (129) may comprise an electric motor (129A) and a reduction gear device (129B). The shaft coupled to the central portion of the roller (125) may be connected to the reduction gear device (129B). When the reduction gear device (129B) is provided, the roller base (123) may be provided in a truncated pyramid shape with a space therein. The reduction gear device (129B) may be located in a space provided inside the roller base (123). The reduction gear device 129B may be connected to the electric motor (129A). When receiving an input from a controller (not shown) connected to the electric motor (129A), the reduction gear device (129B) may operate to fix the shaft so that it does not rotate. As the shaft is fixed, the roller (125) coupled to the shaft may also stop. The support member (120) may serve as a brake by having the geared motor (129) and may prevent reverse rotation of the rotary frame member (140).

In addition, the roller (125) may be made of a material having high friction, such as rubber or silicone. When the roller (125) stops, the rotary frame member (140) may also stop rotating due to frictional force with the roller (125).

According to the present invention, the angle variable multi-stage sunshade device (100) which has the support member (120) comprising both the 1st support (121) and the 2nd support (122) enables turning in a fixed position while preventing the rotary frame member (140) from moving and shaking.

Referring back to FIG. 1, the baseplate member (130) is installed on the upper surface of the 1st support (121), and may be formed in a flat plate shape. More specifically, it may be seated on the 2nd vertical frame (128) of the 1st support (121). The baseplate member (130) may be made of a flat material such as a wooden board so that the user can sit under the sunshade.

Figure 5:
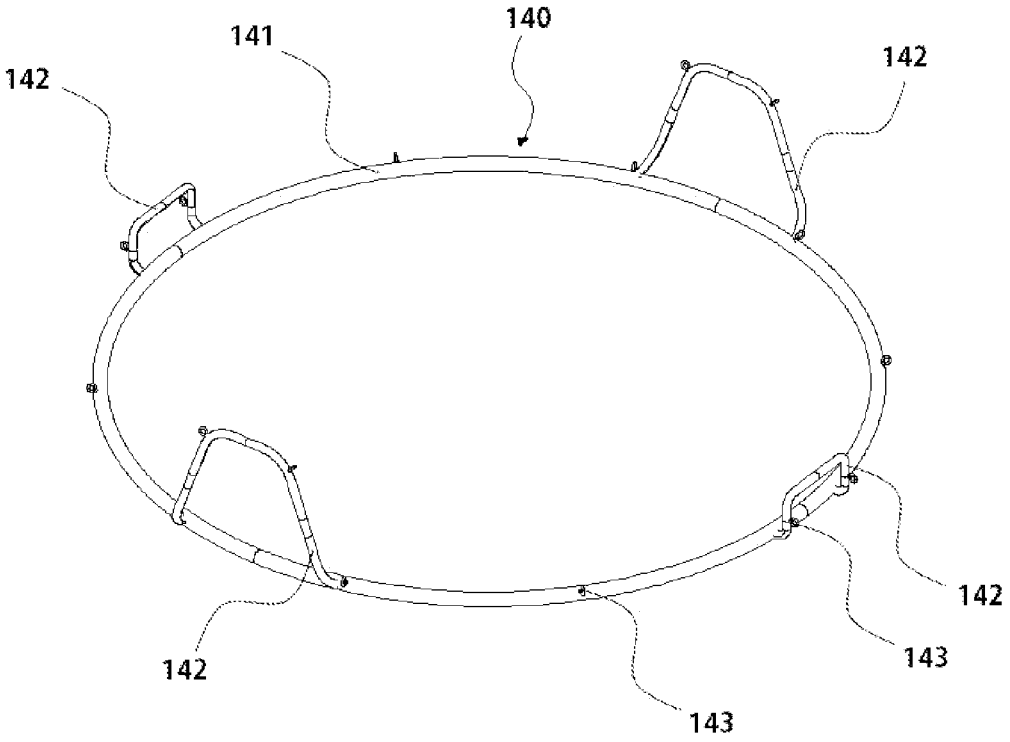
FIG. 5 is a view showing a rotary frame member according to an embodiment of the present invention.

FIG. 5 shows the rotary frame member (140) in more detail.

FIG. 5 is a view showing a rotary frame member (140) according to an embodiment of the present invention.

Referring to FIG. 5, the rotary frame member (140), which is installed on the side of the first support (121), may combine a circular frame (141) formed in a circular ring shape, multiple bent frames (142), and multiple fixing parts (143).

The circular frame (141) may have a diameter slightly long than the width of the baseplate member (130).

In addition, each of the bent frames (142) may have different heights and widths as needed.

In addition, the fixing part (143) is formed in a ring shape of a size through which the deployment control member (170) can pass, and may be provided in multiple numbers at a predetermined interval between the circular frame (141) and the bent frame (142).

As the rotary frame member (140) rotates along the support member (120), the user can easily turn the sunshade in a desired direction.

Referring back to FIG. 1, the rotary support member (150) may be fixed to the bent frame (142).

Figure 6:
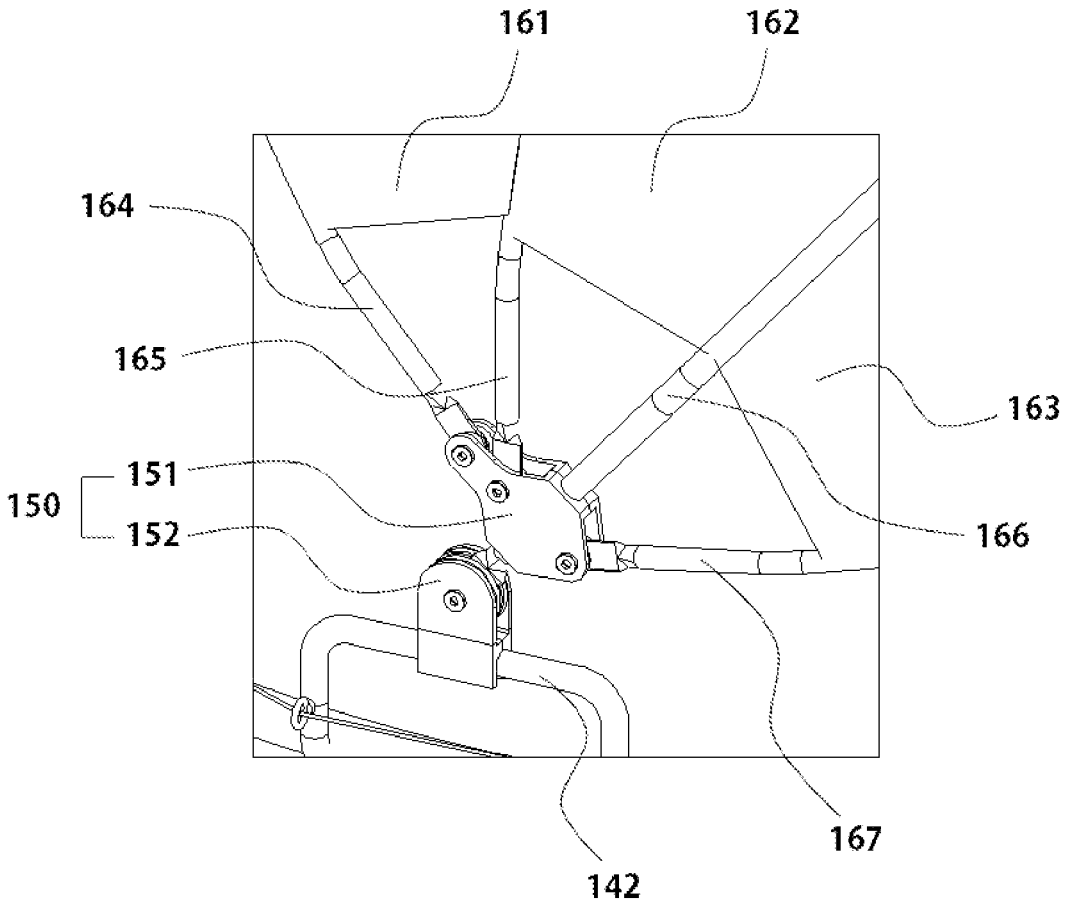
FIG. 6 is a view showing a rotary support member according to an embodiment of the present invention.

FIG. 6 shows the rotary support member (150) in more detail.

FIG. 6 is a view showing a rotary support member (150) according to an embodiment of the present invention.

Referring to FIG. 6, the rotary support member (150) may comprise a 1st rotary bracket (151) and a 2nd rotary bracket (152).

The 1st rotary bracket (151) may be rotatably coupled to the sunshade member (160). The 1st rotary frame (164), the 2nd rotary frame (165), and the 4th rotary frame (167) of the sunshade member (160) are rotatably coupled to the 1st rotation bracket (151), and the 3rd rotary frame (166) may be fixedly coupled.

The 1st rotary bracket (151) may be rotatably coupled to the 2nd rotary bracket (152). Accordingly, the 1st rotary bracket (151) and the sunshade member (161), coupled to the 1st rotary bracket (151), may rotate by 180° around the 2nd rotary bracket (152).

In addition, the rotary support member (150) may be provided at both ends of the sunshade member (161), one for each end.

Referring back to FIG. 1, the sunshade member (160) may be rotatably installed on the rotary support member (150).

The sunshade member (160) may provide shade to the user by blocking sunlight.

Figure 7:
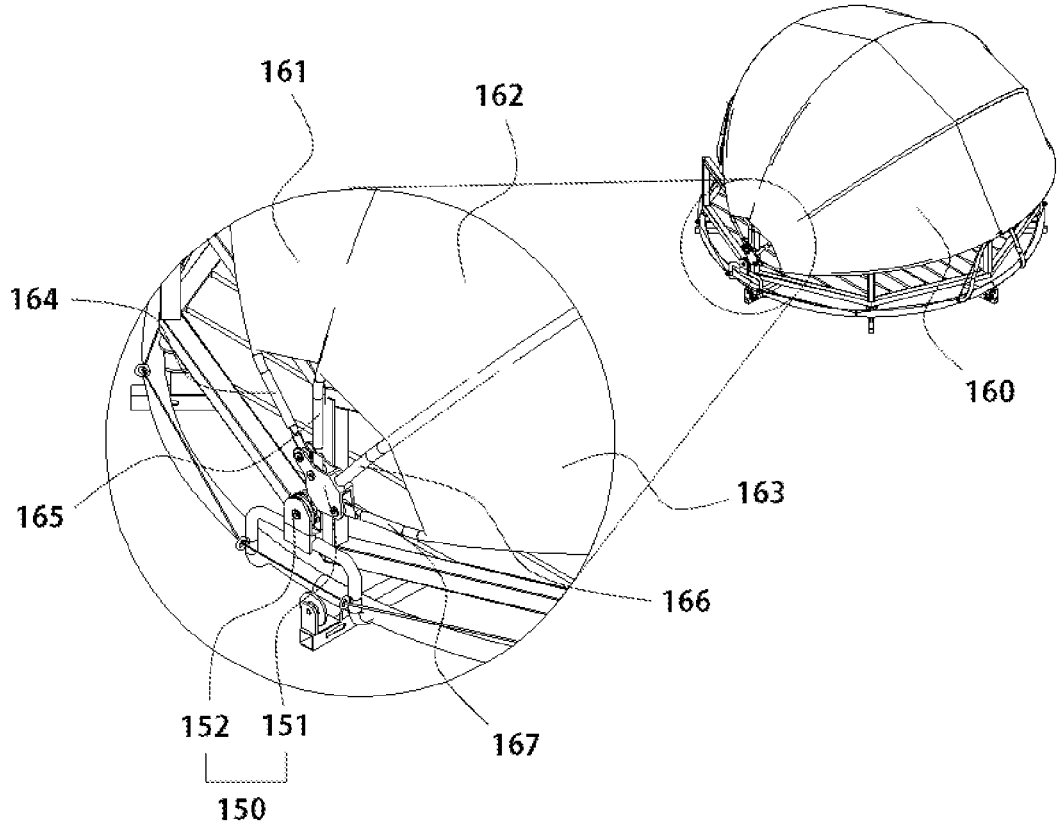
FIG. 7 is a view showing a rotary support member and a sunshade member according to an embodiment of the present invention.

FIG. 7 shows the sunshade member (160) in more detail.

FIG. 7 is a view showing a rotary support member (150) and a sunshade member (160) according to an embodiment of the present invention.

Referring to FIG. 7, the sunshade member (160) according to an embodiment of the present invention may comprise a 1st sunshade (161), a 2nd sunshade (162), a 3rd sunshade (163), a 1st rotary frame (164), a 2nd rotary frame (165)), a 3rd rotary frame (166), and a 4th rotary frame (167).

The 1st sunshade (161) may be formed in a radial arc shape to form a shading space.

The 2nd sunshade (162), provided adjacent to the 1st sunshade (161), may be formed in a radial arc shape to form a shading space.

The 3rd sunshade (163), provided adjacent to the 2nd sunshade (162), may be formed in a radial arc shape to form a shading space.

The 1st rotary frame (164), fixing one end of the 1st sunshade (161), may be rotatably coupled to the 1st rotary bracket (151).

The 2nd rotary frame (165), fixing the other end of the 1st sunshade (161) and one end of the 2nd sunshade (162), may be rotatably coupled to the 1st rotary bracket (151).

The 3rd rotary frame (166), fixing the other end of the 2nd sunshade (162) and one end of the 3rd sunshade (163), may be rotatably coupled to the 1st rotary bracket (151).

The 4th rotary frame (167), fixing the other end of the 3rd sunshade (163), may be rotatably coupled to the 1st rotary bracket (151).

At this time, the 1st rotary frame (164), the 2nd rotary frame (165), the 3rd rotary frame (166), and the 4th rotary frame (167) may all have the same diameter.

Figure 11:
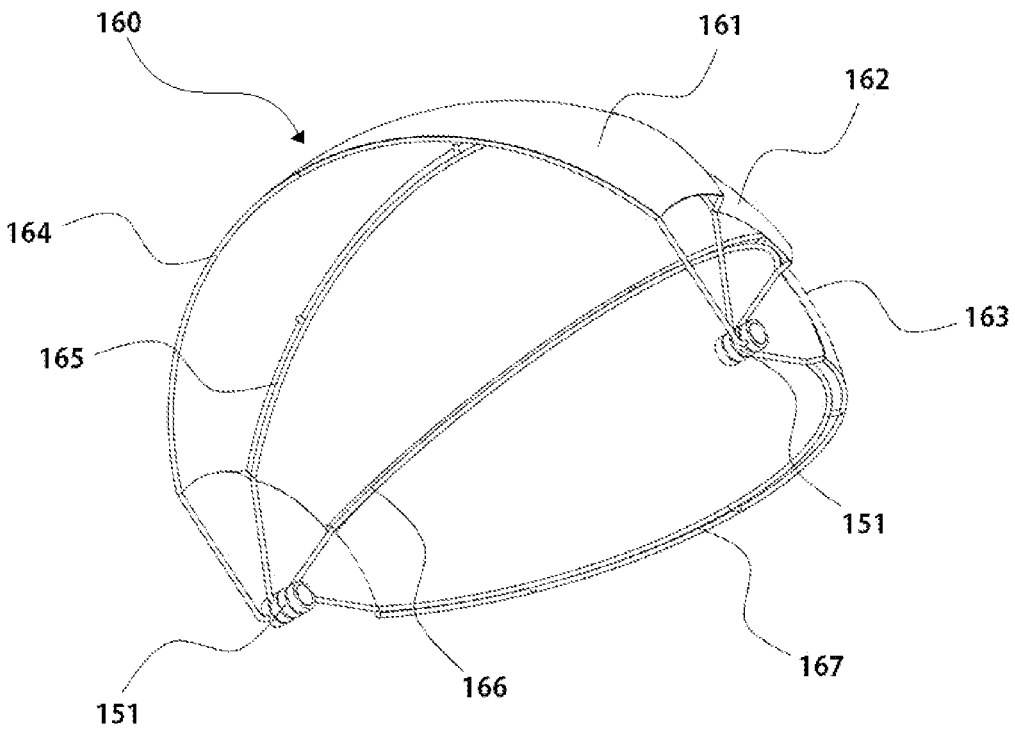
FIG. 11 is a bottom view showing a sunshade member according to another embodiment of the present invention.
Figure 12:
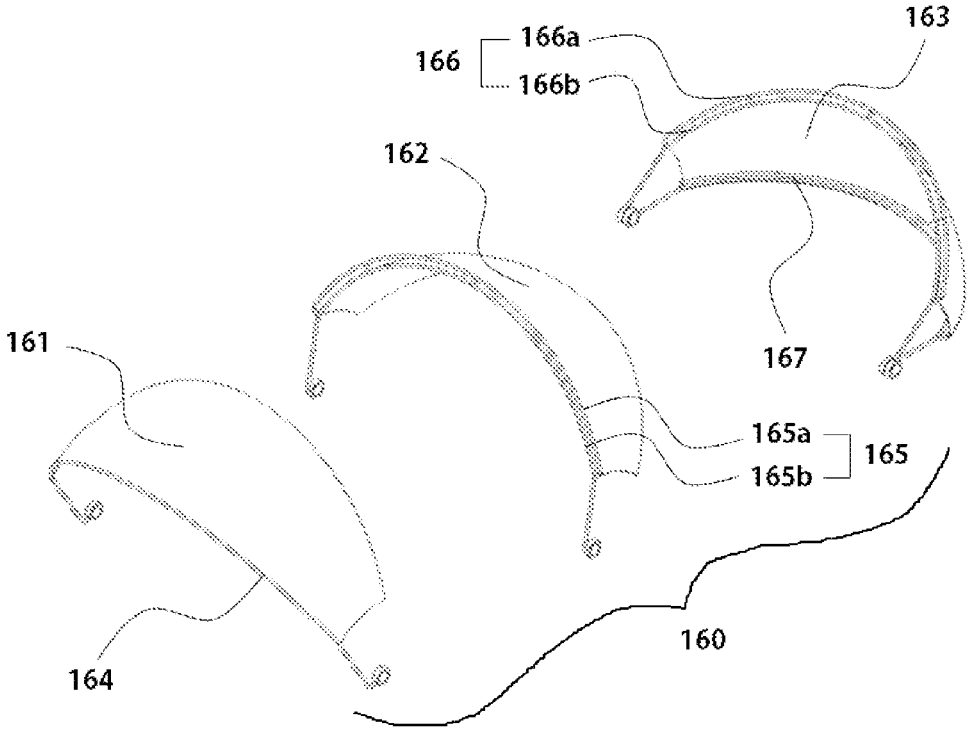
FIG. 12 is a bottom view showing an exploded sunshade member according to another embodiment of the present invention.

On the other hand, the sunshade member (160) may be provided in another embodiment as shown in FIG. 11 and FIG. 12.

FIG. 11 is a bottom view showing a sunshade member (160) according to another embodiment of the present invention, and FIG. 12 is a bottom exploded view.

As shown in FIG. 11, the sunshade member (160) according to another embodiment of the present invention may comprise a 1st sunshade (161), a 2nd sunshade (162), a 3rd sunshade (163), a 1st rotary frame (164), a 2nd rotary frame (165), a 3rd rotary frame (166), and a 4th rotary frame (167).

Referring to FIG. 11 and FIG. 12, the 1st sunshade (161) may be formed in a radial arc shape to form a shading space.

The 2nd sunshade (162) is provided adjacent to the 1st sunshade (161), and may be formed in a radial arc shape to form a shading space. In addition, the 2nd sunshade (162) may be formed to have a smaller diameter than the 1st sunshade (161) so that the 2nd sunshade (162) can be folded into the 1st sunshade (161).

The 3rd sunshade (163) is provided adjacent to the 2nd sunshade (162), and may be formed in a radial arc shape to form a shading space. In addition, the 3rd sunshade (163) may be formed to have a smaller diameter than the 2nd sunshade (162) so that the 3rd sunshade (163) can be folded into the 2nd sunshade (162).

Each of the sunshade members (160) is formed in a cone shape, and is installed so that a user can selectively deploy (expand and fold) the sunshades (161, 162, and 163).

The 1st rotary frame (164) may fix one end of the 1st sunshade (161), and may be rotatably coupled to the 1st rotary bracket (151).

The 2nd rotary frame (165) may consist of a 2nd-1 rotary frame (165*a*) having a larger arc diameter and a 2nd-2 rotary frame (165*b*) having a smaller diameter than the 2nd-1 rotary frame (165*a*), and may be rotatably coupled to the bracket (151). The 2nd-1 rotary frame (165*a*) may be coupled to the other end of the 1st sunshade (161) and the 2nd-2 rotary frame (165*b*) may be coupled to one end of the 2nd sunshade (162). The difference in height between the 2nd-1 rotary frame (165*a*) and the 2nd-2 rotary frame (165*b*) forms a gap between the 1st sunshade (134) and the 2nd sunshade (140), introducing wind from the outside of the sunshade member (160).

The 3rd rotary frame (166) may consist of a 3rd-1 rotary frame (166*a*) having a larger arc diameter and a 3rd-2 rotary frame (166*b*) having a smaller diameter than the 3rd-1 rotary frame (166*a*). The 3rd-1 rotary frame (166*a*) may be provided to be spaced apart by a predetermined height from the 3rd-2 rotary frame (166*b*). The 3rd-1 rotary frame (166*a*) may be coupled to the other end of the 2nd sunshade (162) and the 3rd-2 rotary frame (166*b*) may be coupled to one end of the 3rd sunshade (163). The difference in height between the 3rd-1 rotary frame (166*a*) and the 3rd-2 rotary frame (166*b*) forms a gap between the 2nd sunshade (162) and the 3rd sunshade (163), introducing wind from the outside of the sunshade member (160).

The 4th rotary frame (167) may be fixed to the other end of the 3rd sunshade (163), and may be rotatably coupled to the 1st rotary bracket (151).

Referring back to FIG. 1, the deployment control member (170) may be installed to adjust the unfolding position of the sunshade member (160), and to adjust the interval at which the sunshade member (160) is unfolded.

Figure 8:
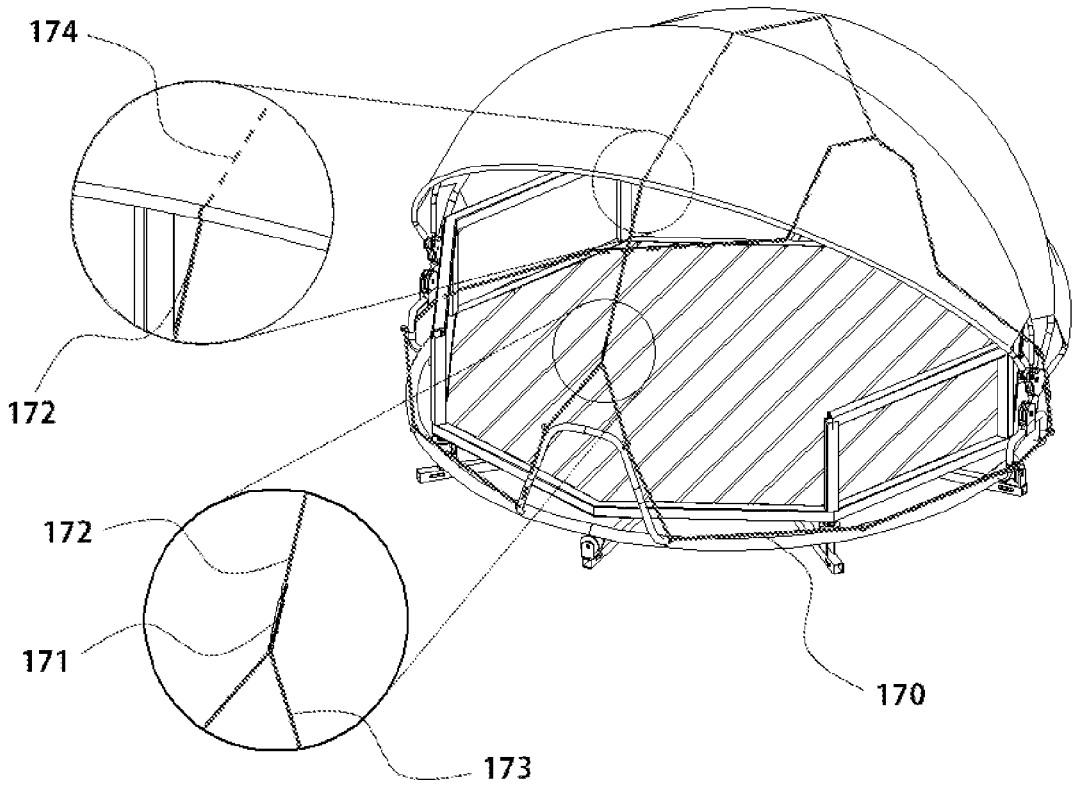
FIG. 8 is a view showing a deployment control member according to an embodiment of the present invention.

FIG. 8 shows the deployment control member (170) in more detail.

FIG. 8 is a view showing a deployment control member (170) according to an embodiment of the present invention.

Referring to FIG. 8, the deployment control member (170) may comprise a 1st wire (172) and a 2nd wire (173).

The 1st wire (172) may have one end fixed to the 1st rotary frame (164) and the other end fixed to the turnbuckle (171). Here, the turnbuckle (171) refers to a mechanism for adjusting the length of a support bar or a support wire rope. The 1st wire (172) tensions the deployed sunshade member (160), thereby stably maintaining the deployed state of the sunshade member (160). In addition, the binding structure of the 1st wire (172) and the 2nd wire (173) is useful to maintain stability against strong wind.

The 2nd wire (173) may pass through the multiple fixing parts (143), with one end fixed to the turnbuckle (171) and the other end fixed to the 4th rotary frame (167). The turnbuckle (171) can adjust the lengths of the 1st wire (172) and the 2nd wire (173), as well as release the 1st wire (172) from the turnbuckle 171 to fold the sunshade member (160).

That is, the sunshade member (160) can be easily folded by releasing the 1st wire (172) or the 2nd wire (173) connected to the turnbuckle (171).

In addition, the deployment control member (170) may further comprise a 3rd wire (174).

The 3rd wire (174) connects one end of the 1st wire (172) and the other end of the 2nd wire (173), and may be fixed to the 1st rotary frame (164), the 2nd rotary frame (165), and the 3rd rotary frame (166), and the 4th rotary frame (167).

In addition, the deployment control member (170) may be made of a wire having sufficient strength to support the weight of the sunshade member (160).

In addition, the deployment control member (170) may further comprise an elastic adjustment member (not shown). The elastic adjustment member may be provided between the 2nd wire (173) and the 3rd wire (174). The elastic control member normally applies a force in the folding direction of the sunshade member (160), and when the user combines the 1st wire (172) with the turnbuckle (171), the elastic force is balanced so that the sunshade member (160) can be maintained in an unfolded state. By being provided with the elastic adjustment member, the sunshade member (160) can be automatically folded as soon as the connection between the 1st wire (172) and the turnbuckle (171) is released.

In addition, the deployment control member (170) may comprise a gas spring (not shown). The gas spring may be provided between the 2nd wire (173) and the 3rd wire (174). Since the gas spring is a conventional one that reciprocates the piston rod by high-pressure gas, a detailed description thereof will be omitted. The gas spring may adjust the height of the 3rd sunshade (163) connected to the 3rd wire (174).

That is, by lowering the gas spring, the user can lower the height of the 3rd sunshade (163), and accordingly lower the height at which the 1st sunshade (161) and the 2nd sunshade (162) are deployed. By being provided with the gas spring, the angle variable multi-stage sunshade device (100) according to the present invention can deploy the sunshade member (160) at a low position to block the sunlight in the morning or evening when the sun is low, and at a high position to block the sunlight during lunchtime when the sun is high.

Referring back to FIG. 1, the angle variable multi-stage sunshade device (100) according to an embodiment of the present invention may further comprise a fence member (180).

Figure 10:
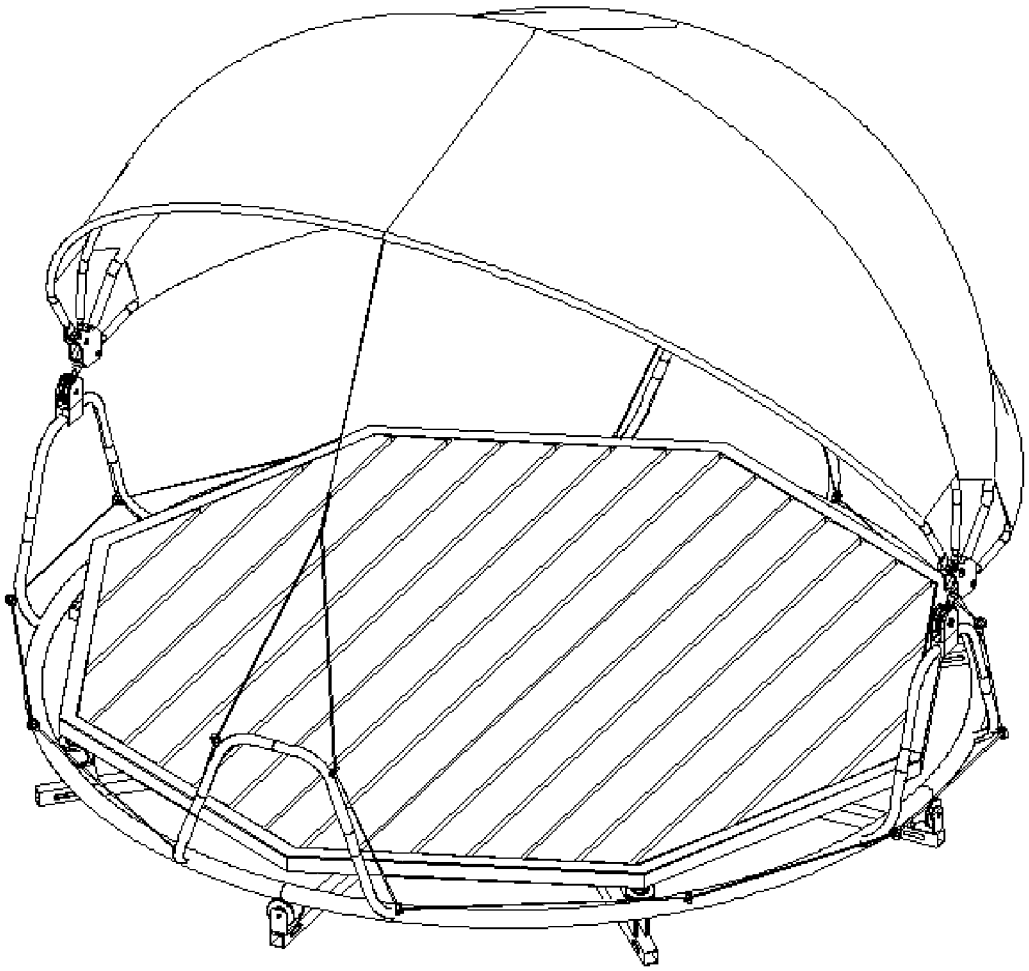
FIG. 10 is a view showing the angle variable multi-stage sunshade device without a fence member according to an embodiment of the present invention.

The fence member (180) may be installed along the circumference of the baseplate member (130). The fence member (180) can be additionally installed and used for the convenience of the user, and may be excluded as needed as shown in FIG. 10.

Figure 9:
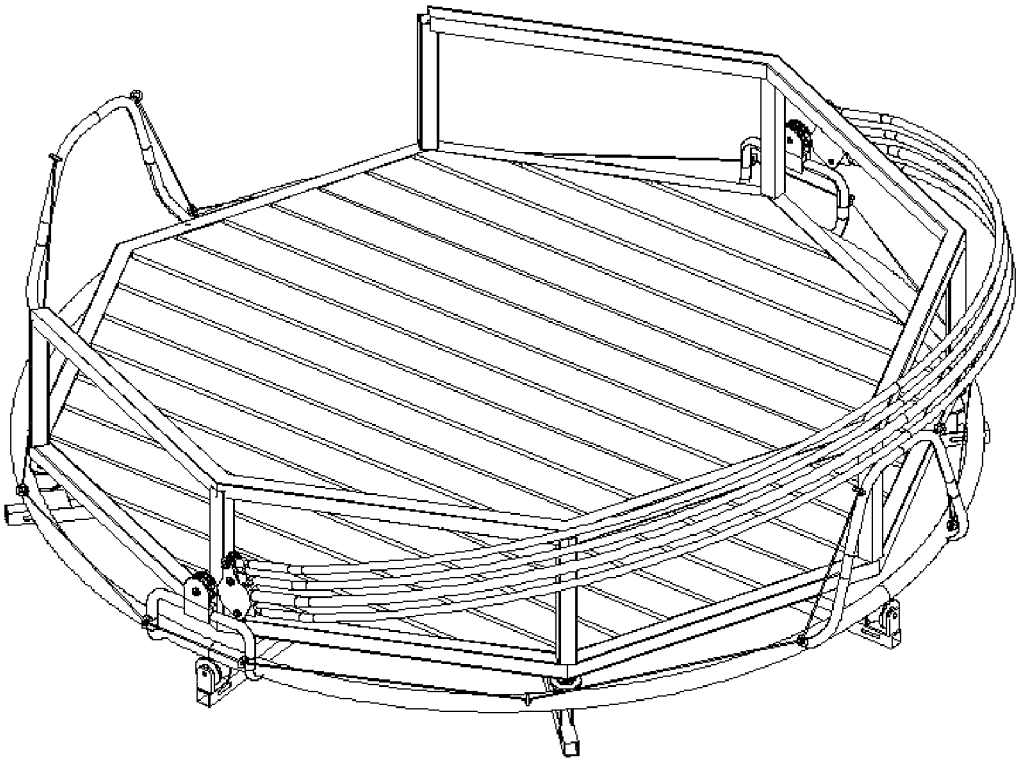
FIG. 9 is a view showing the folded state of the sunshade in the angle variable multi-stage sunshade device according to an embodiment of the present invention.

FIG. 9 is a view showing the folded state of the sunshade in the angle variable multi-stage sunshade device (100) according to an embodiment of the present invention.

As shown in FIG. 9, the sunshade member (160) may be easily folded by releasing the 1st wire (172) or the 2nd wire (173) connected to the turnbuckle (171).

When the 1st wire (172) or the 2nd wire (173) is released from the turnbuckle (171), the sunshade member (160) can freely rotate around the rotary support member (150), and accordingly, the 1st rotary frame (164), the 2nd rotary frame (165), the 3rd rotary frame (166), and the 4th rotary frame (167) can be sequentially folded.

Hereinafter, the structure of the angle variable multi-stage sunshade device (100) according to the present invention and an operation related thereto will be described with reference to FIGS. 1 to 12.

First, referring to FIG. 1, a base member (110) may be provided on the ground. A rotary frame member (140) and a baseplate member (130) may also be provided along the support member (120) seated at a predetermined distance from the top end of the base member (110). The rotary support member (150) may be fixed to the rotary frame member (140), and a sunshade member (160) may be rotationally coupled to the rotary support member (150). A deployment control member (170) may be connected to the rotary frame member (140) and the sunshade member (160).

The user may sit on the baseplate member (130) and take a break. The sunshade member (160) can be opened and closed by adjusting the deployment control member (170). When the 1st wire (172) of the deployment control member (170) is pulled and coupled to the turnbuckle (171), the deployment control member (170) is tightly fixed and the sunshade member (160) fixed to the deployment control member (170) can also be fully deployed. The 1st wire (172) tensions the deployed sunshade member (160), thereby stably maintaining the deployed state of the sunshade member (160). In addition, the angle and height of the sunshade member (160) can be adjusted little by little by rotating the center of the turnbuckle (171). When removing the sunshade member (160), if the coupling between the turnbuckle (171) and the 1st wire (172) or the 2nd wire (173) is released, the sunshade member (160) freely rotates around the rotary support member (150), and as shown in FIG. 9, the rotary frames (164, 165, 166, 167) of the sunshade member (160) are gathered to one side, making it easy to fold the sunshade member (160).

In addition, the deployment control member (170) has an elastic adjustment member to apply a force in the direction of folding the sunshade member (160) in usual times. When the user combines the 1st wire (172) with the turnbuckle 1(71), the elastic force is balanced so that the sunshade member (160) can be maintained in an unfolded state. By being provided with the elastic adjustment member, the sunshade member (160) can be automatically folded as soon as the connection between the 1st wire (172) and the turnbuckle 171 is released.

In addition, the deployment control member (170) may have a gas spring to adjust the height of the sunshade member (160). When the user lowers the gas spring, the height of the 3rd sunshade (163) is lowered, and accordingly, the height at which the 1st sunshade (161) and the 2nd sunshade (162) are deployed can be lowered. By being provided with the gas spring, the angle variable multi-stage sunshade device (100) according to the present invention can unfold the sunshade member (160) at a low position to block the sunlight in the morning or evening when the sun is low, and at a high position to block the sunlight during lunchtime when the sun is high.

In addition, the direction of the sunshade member (160) can be changed easily according to the user's convenience by rotating the rotary frame member (140 When an external force is applied while the rotary frame member (140 is seated on the roller (125) of the support member (120), the rotary frame member (140 may rotate along the path guided by the roller (125). At this time, by being alternately provided with the 1st support (121) having the roller (125) in the direction to one side and the 2nd support (122) having the roller (125) in the upward direction, the support member (120) may prevent movement and shaking of the rotary frame member (140), thereby making it rotate in a fixed position.

In addition, when the rotary frame member (140 rotates, the 2nd wire (173), wound along the circumference of the rotary frame member (140, rotates together to turn the sunshade member (160) in a desired direction without being limited by the location of the deployment control member (170).

In addition, a fence member (180) can be installed and used according to the user's convenience.

As described above, according to an embodiment of the present invention, the use of a rotary frame member allows the user to easily turn the sunshade in a desired direction.

In addition, according to the present invention, by using the turnbuckle, it is possible to easily adjust the angle of the sunshade and fold the sunshade.

In addition, according to the present invention, by using different types of support members at the same time, it is possible to prevent the center movement and shaking of the sunshade during rotation of the sunshade, and to turn the sunshade at a fixed position.

In addition, according to the present invention, by using a wire, it is possible to stably maintain the sunshade deployed state.

Embodiment 2

The angle variable multi-stage sunshade device according to an embodiment of the present invention comprises: a support member (1110) consisting of a 1st support (1111) installed on one side and a 2nd support (1112) installed to be spaced apart by a predetermined distance from the 1st support (1111); and a sunshade member (1130) consisting of multiple sunshade units (131, 135, 141) that are rotatably installed on the 1st support (1111) and the 2nd support (1112), respectively.

Figure 14:
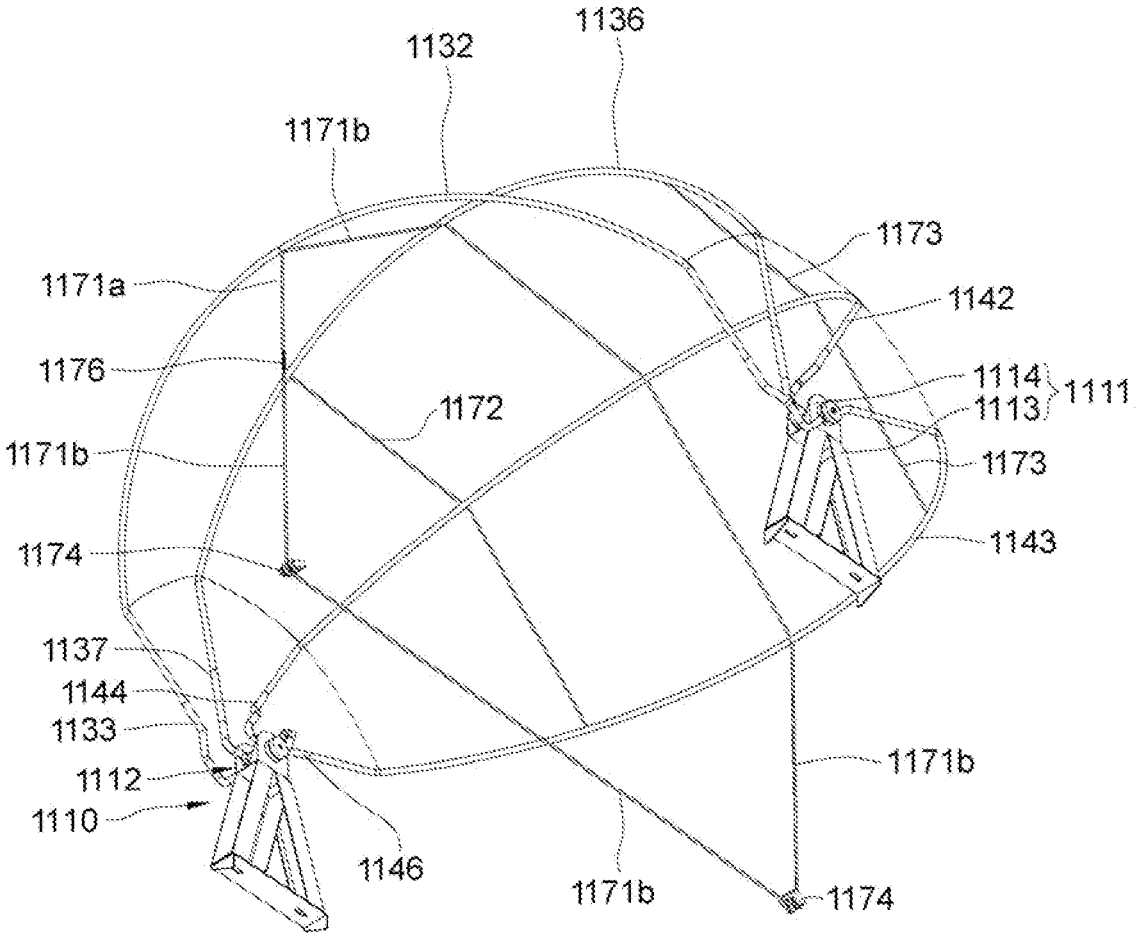
FIG. 14 is a bottom single-view drawing showing an angle variable multi-stage sunshade device according to a preferred embodiment of the present invention.
Figure 15:
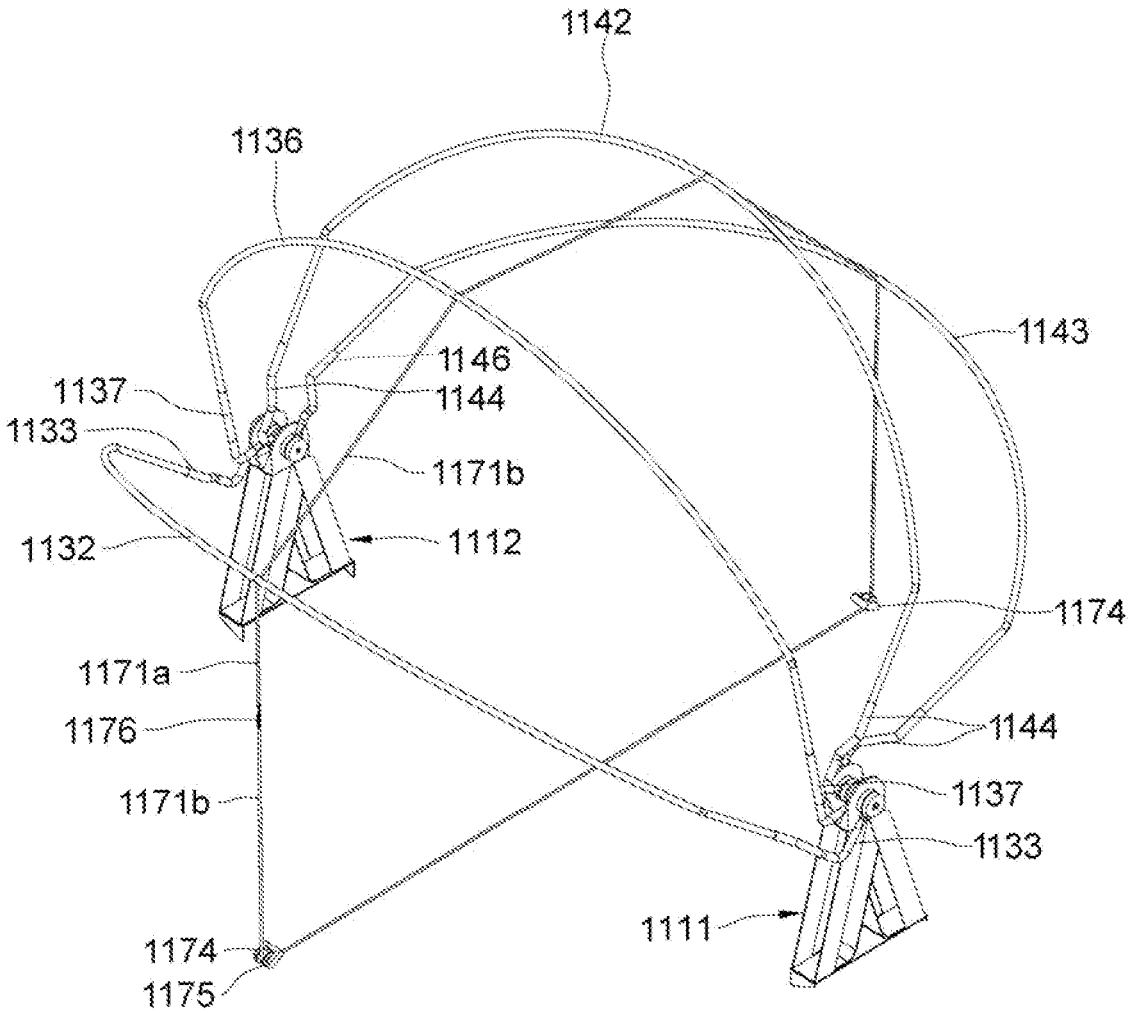
FIG. 15 is a single-view drawing showing an angle variable multi-stage sunshade device according to a preferred embodiment of the present invention.

FIG. 14 is a bottom single-view drawing showing an angle variable multi-stage sunshade device according to a preferred embodiment of the present invention, and FIG. 15 is a bottom single-view drawing showing an angle variable multi-stage sunshade device according to a preferred embodiment of the present invention.

As shown in FIG. 14 to FIG. 15, the angle variable multi-stage sunshade device according to an embodiment of the present invention comprises a pair of support members (1110) for supporting multiple sunshade units (131, 135, 141), a sunshade member (1130) that is rotatably installed on the support member (1110), and a deployment control member (1170) that stably maintains the deployed state of the sunshade member (1130).

The support member (1110) comprises a 1st support (1111) installed in the lower portion of one side of the sunshade member (1130) and a 2nd support (1112) installed in the lower portion of the other side of the sunshade member (1130).

The 1st support (1111) and the 2nd support (1112) have the same structure, and the support members (11, 112) include a support (1113) formed to have a predetermined height, a rotary bracket (1114) to be installed on the upper surface of the support (1113), and rotatably coupled to multiple sunshade units (131, 135, 141).

The support (1113) is formed to have a predetermined height, and a rotary bracket (1114) is installed on the upper surface of the support (1113) so that the sunshade member (1130) is rotatably coupled.

The sunshade member (1130) blocks sunlight to provide shade to the user, and is rotatably coupled to the rotary bracket (1114).

Figure 16:
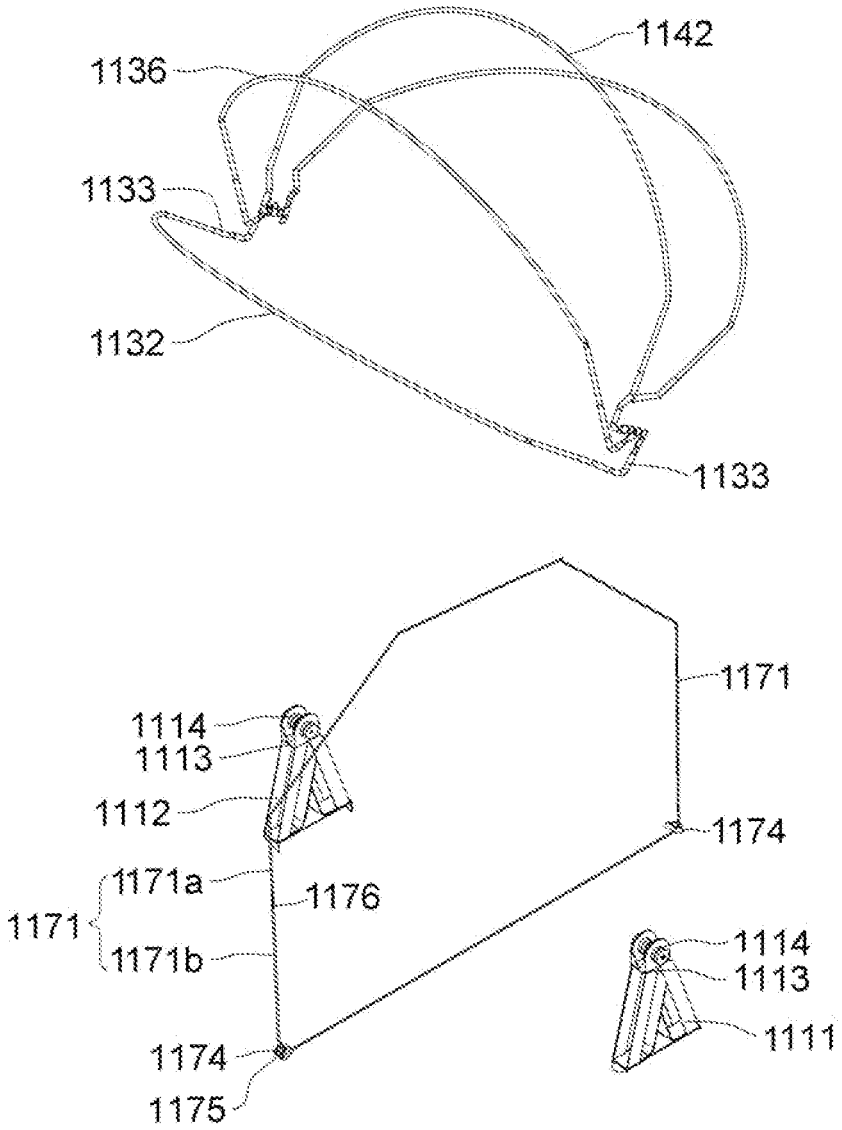
FIG. 16 is an exploded single-view drawing showing an angle variable multi-stage sunshade device according to a preferred embodiment of the present invention.
Figure 17:
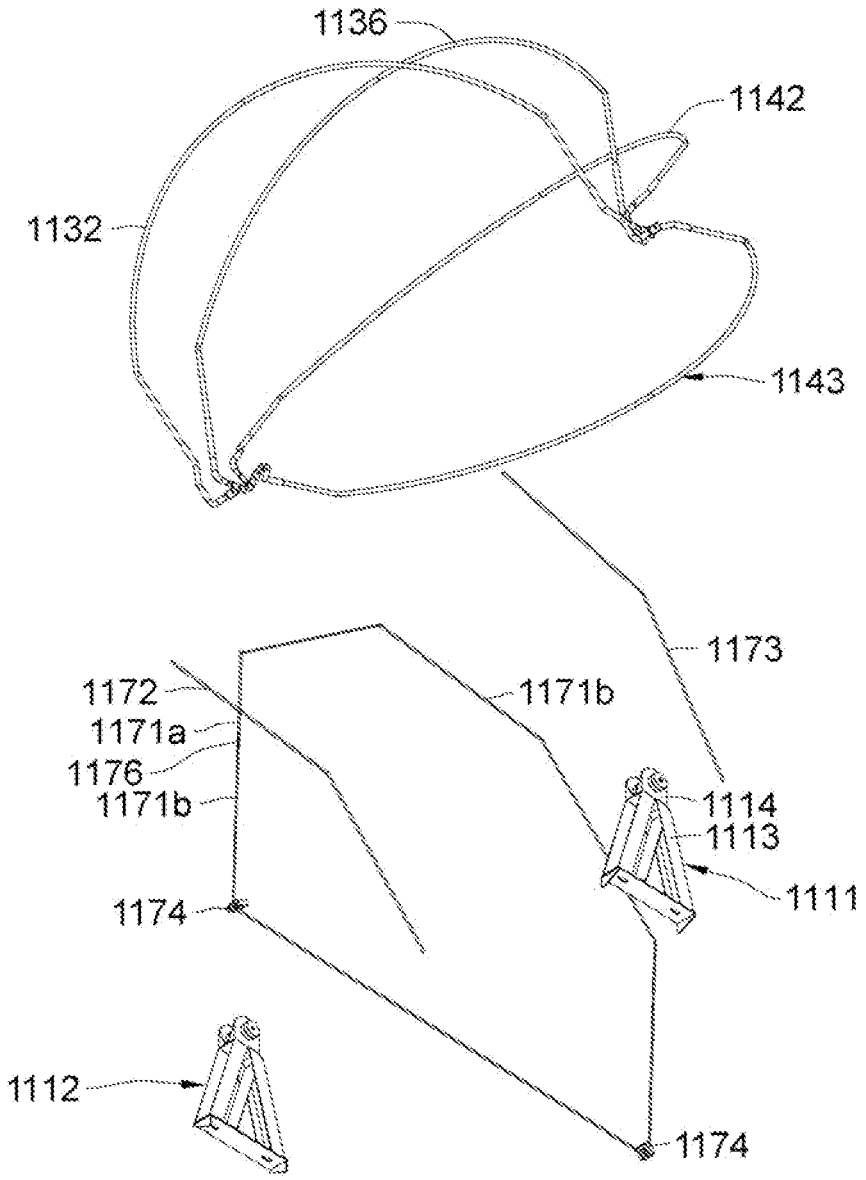
FIG. 17 is a bottom exploded single-view drawing showing an angle variable multi-stage sunshade device according to a preferred embodiment of the present invention.
Figure 18:
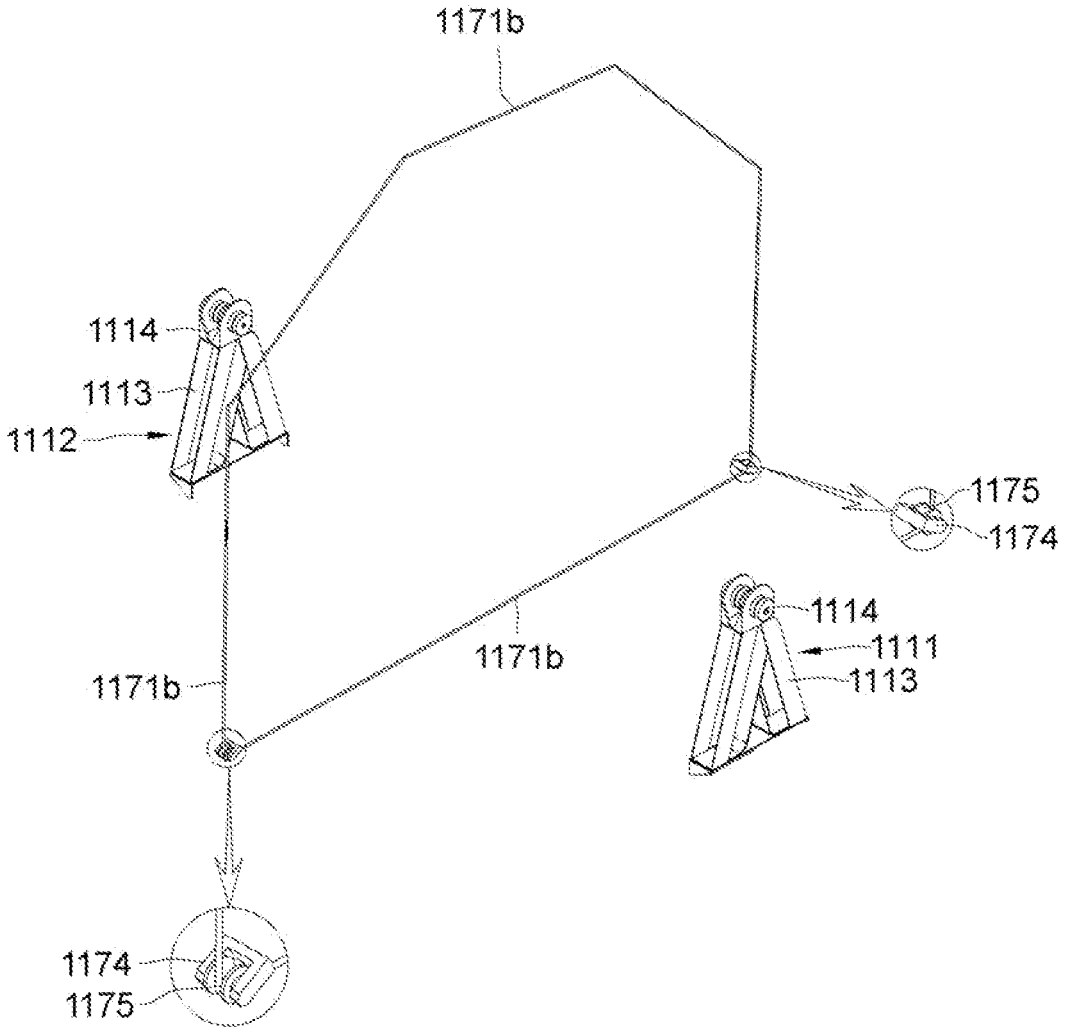
FIG. 18 is an enlarged single-view drawing showing the deployment control member of an angle variable multi-stage sunshade device according to a preferred embodiment of the present invention.

FIG. 16 is an exploded single-view drawing showing an angle variable multi-stage sunshade device according to a preferred embodiment of the present invention, FIG. 17 is a bottom exploded single-view drawing showing an angle variable multi-stage sunshade device according to a preferred embodiment of the present invention, and FIG. 18 is an enlarged single-view drawing showing the deployment control member of an angle variable multi-stage sunshade device according to a preferred embodiment of the present invention.

Figure 19:
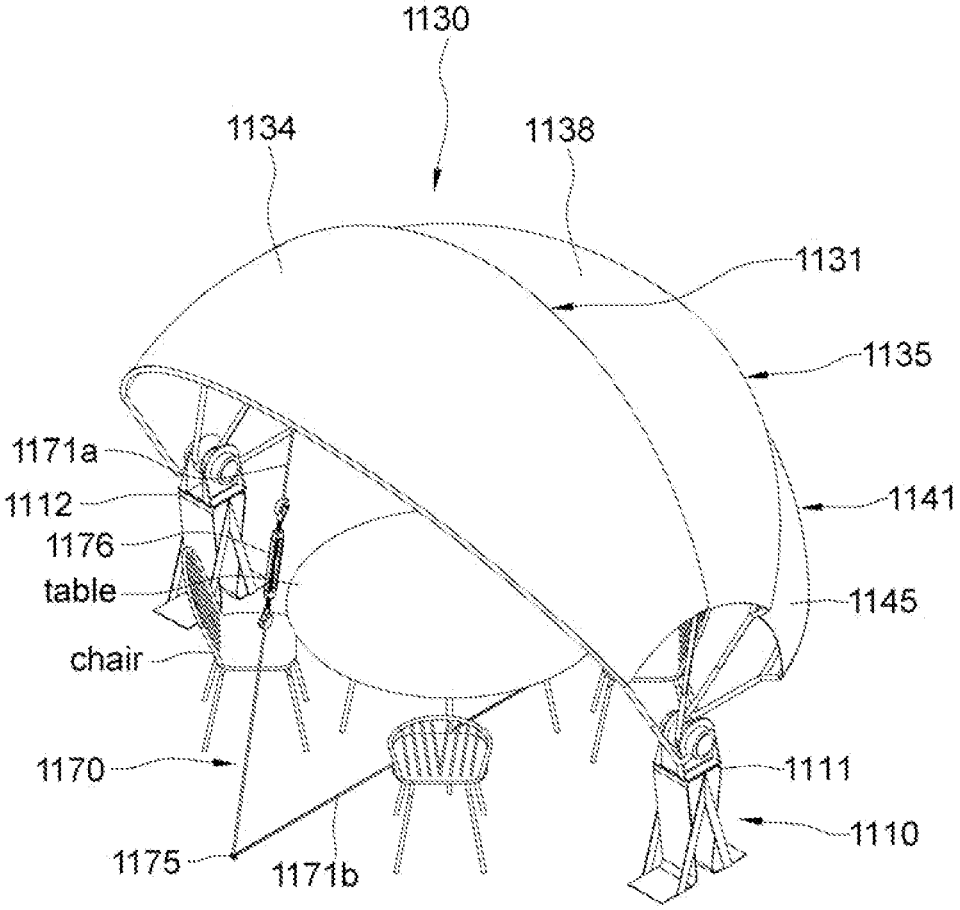
FIG. 19 is a single-view drawing showing a deployed state of an angle variable multi-stage sunshade device according to a preferred embodiment of the present invention.
Figure 20:
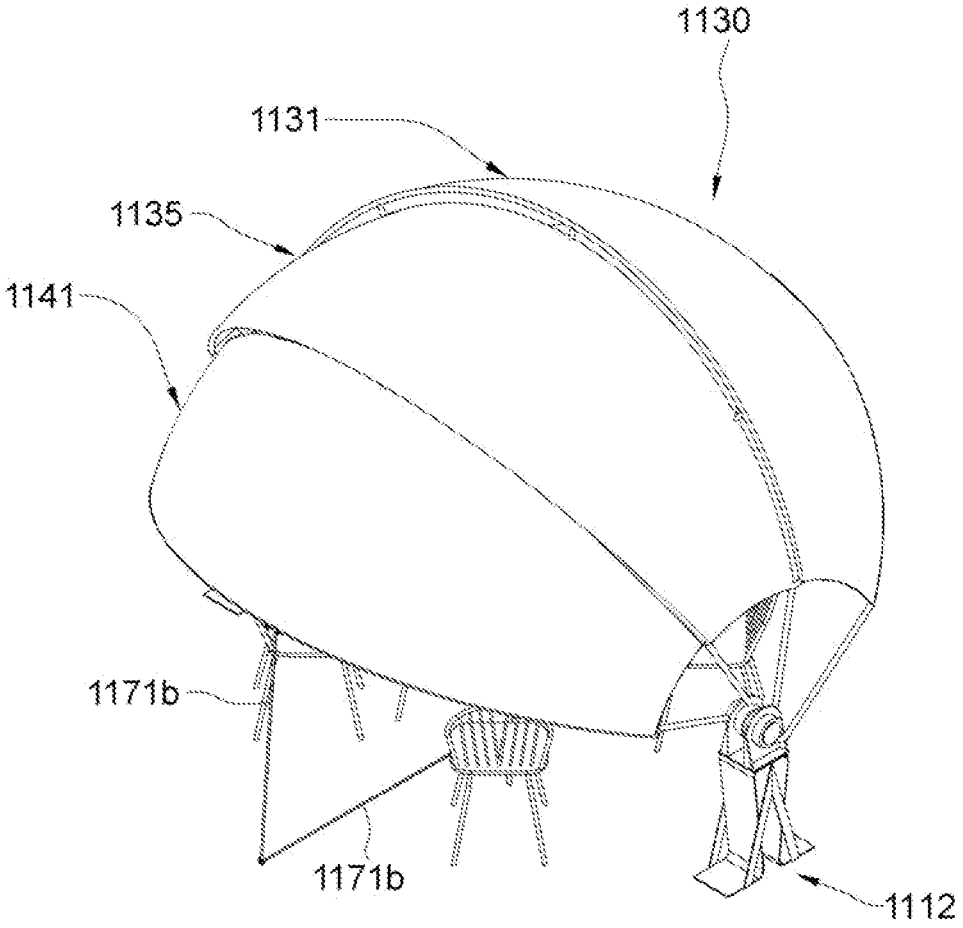
FIG. 20 is a single-view drawing showing a state in which an angle variable multi-stage sunshade device is deployed on the top according to a preferred embodiment of the present invention.

FIG. 19 is a single-view drawing showing a deployed state of an angle variable multi-stage sunshade device according to a preferred embodiment of the present invention, and FIG. 20 is a single-view drawing showing a state in which an angle variable multi-stage sunshade device is deployed on the top according to a preferred embodiment of the present invention.

As shown in FIG. 16 to FIG. 20, the sunshade member (1130) consists of: a 1st sunshade unit (1131) that is rotatably coupled to the support member (1110), and formed in a radial arc shape to form a shading space; a 2nd sunshade unit (1135) that is rotatably coupled to the support member (1110), and formed in a radial arc shape to form a shading space; and a 3rd sunshade unit (1141) that is rotatably coupled to the support member (1110), and formed in a radial arc shape to form a shading space.

The sunshade members (1130) are formed in a cone shape, respectively, and installed so that the user can selectively deploy (expand and fold) the sunshade units (131, 135, 141).

A 1st sunshade frame (1132) for fixing one end of the 1st sunshade (1134) is fixed to the 1st sunshade unit (1131), a 1st rotary frame (1133) coupled to the rotary bracket (1114) is integrally formed on both sides of the 1st sunshade frame (1132), respectively, and the 1st rotary frame (1133) is rotatably coupled to the rotary bracket (1114).

The 1st sunshade frame (1132) is provided with a 1st sunshade (1134) in the shape of a headband.

In addition, the 2nd sunshade unit (1135) is provided with a 2nd sunshade frame (1136) for fixing one end of the 2nd sunshade (140), and one end of the 1st sunshade (1134) and one end of the 2nd sunshade (1138) are fixed to the 2nd sunshade frame (1136).

One end of the 1st sunshade (1134) is fixed to the 1st sunshade frame (1132), and the other end of the 1st sunshade (1134) is fixed to the 2nd sunshade frame (1136).

A 2nd rotary frame (1137) to be coupled to a rotary bracket (1114) is integrally formed at both ends of the 2nd sunshade frame (1136), respectively, and the 2nd rotary frame (139) is rotatably coupled to the rotary bracket (1114).

The 2nd sunshade unit (1135) is formed to have a smaller diameter than the 1st sunshade unit (1131) so that the 2nd sunshade unit (1135) can be folded into the 1st sunshade unit (1131).

The 3rd sunshade unit (1141) comprises a 3rd sunshade frame (1142) for fixing the 3rd sunshade (1145), and a 3rd rotary frame (1144) is installed at both ends of the 3rd sunshade frame (1142), respectively.

These rotary frames (133, 137, 144) are rotatably coupled to the rotary bracket (1114), respectively.

The 3rd sunshade unit (1141) is formed to have a smaller diameter than the 2nd sunshade unit (1135) so that it can be folded into the 2nd sunshade unit (1135).

As shown in FIG. 17 and FIG. 18, the deployment control member (1170), which is to maintain the tension of the unfolded 1st sunshade unit (1131) and 3rd sunshade unit (1141), comprises: a 1st wire (1171) having one end fixed to the 1st sunshade unit (1131) and the other end fixed to the 3rd sunshade unit (1141); a 2nd wire (1172) having both ends fixed to one side of the 1st sunshade unit (1131) and the 3rd sunshade unit (1141), respectively; a 3rd wire (1173) having both ends fixed to the other side of the 1st sunshade unit (1131) and the 3rd sunshade unit (1141), respectively; and a rotary roller (1175) to be rotatably installed on the fixing bracket (1174) installed on the lower side of the 1st sunshade unit (1131)

One end of the 1st wire (1171) is fixed to the 1st sunshade frame (1132) of the 1st sunshade unit (1131), and the other end of the 1st wire (1171) is fixed to the 3rd sunshade frame (1142) of the 3rd sunshade unit (1141).

The 1st wire (1171) consists of a short wire (171*a*) to be installed between the 1st sunshade unit (1131) and the length control member (1176) and a long wire (171*b*) to be installed between the length control member (1176) and the 3rd sunshade frame (1142).

One end of the short wire (171*a*) is connected to the 1st sunshade frame (1132) of the 1st sunshade unit (1131), and the other end of the short wire (171*a*) is connected to the length control member (1176).

On the other hand, one end of the long wire (171*b*) is connected to the length control member (1176), and the other end of the long wire (171*b*) is connected to the 4th sunshade frame (1144) of the 3rd sunshade unit (1141).

The 1st wire (1171) keep taut the deployed 1st and 3rd sunshade units (1131, 1141) to stably maintain the deployed state of all of the 1st sunshade unit (1131), 2nd sunshade unit (1135) and 3rd sunshade unit (1141).

In addition, the length control member (1176) may use a turnbuckle as an example, and may adjust the length of the short wire (171*a*) and the long wire (171*b*) as well as release the 1st wire (1171) from the length control member (1176) so that the sunshade member (1130) can be folded.

That is, the sunshade member (1130) can be easily folded by releasing the short wire (171*a*) or the long wire (171*b*) connected to the length control member (1176).

In addition, the 2nd wire (1172) is installed on one side inside the 1st sunshade unit (1131) and the 3rd sunshade unit (1141), and the 3rd wire (1173) is installed on the other side inside the 1st sunshade unit (1131) and the 3rd sunshade unit (1141).

These 2nd wire (1172) and 3rd wire (1173) limit the deployment range of the 1st and 3rd sunshade units (1131, 1141).

That is, the 1st sunshade unit (1131) and the 3rd sunshade unit (1141) are deployed in a limited range of the length of the wires (172, 173) by the 2nd wire (1172) and the 3rd wire (1173).

In addition, a pair of fixing brackets (1174) are installed on the lower portion of the length control member (1176), and a rotary roller (1175) allowing the 1st wire (1171) to move smoothly is installed on the fixing bracket (1174).

The 1st sunshade unit (1131) and the 3rd sunshade unit (1141) stably maintain a state deployed by the 1st wire (1171).

That is, when the sunshade member (1130) is deployed to a low position, the 1st wire (1171) is installed while being wound around the outer surface of the pair of rotary rollers (1175) so that the sunshade member (1130) will remain unfolded without being rotated arbitrarily by wind or the like.

This is because the 1st sunshade unit (1131) and the 3rd sunshade unit (1141) are fixed by the 1st wire (1171), respectively, so that the sunshade member (1130) is not rotated by external factors such as wind.

In addition, when the sunshade member (1130) is deployed to a high position, the 1st wire (1171) moves along the rotary roller (1175) of the 1st wire (1171) while being fixed to both ends of the 1st sunshade unit (1131) and the 3rd sunshade unit (1141) according to the deployment position of the sunshade member (1130)

On the other hand, since the length control member (1176) is to generate tension by expanding the sunshade member (1130) and adjusting the length of the wire (1171), a bar stopper (not shown) or a rope ratchet that can adjust the length of the wire (1171) as well as turnbuckle can be used.

Figure 21:
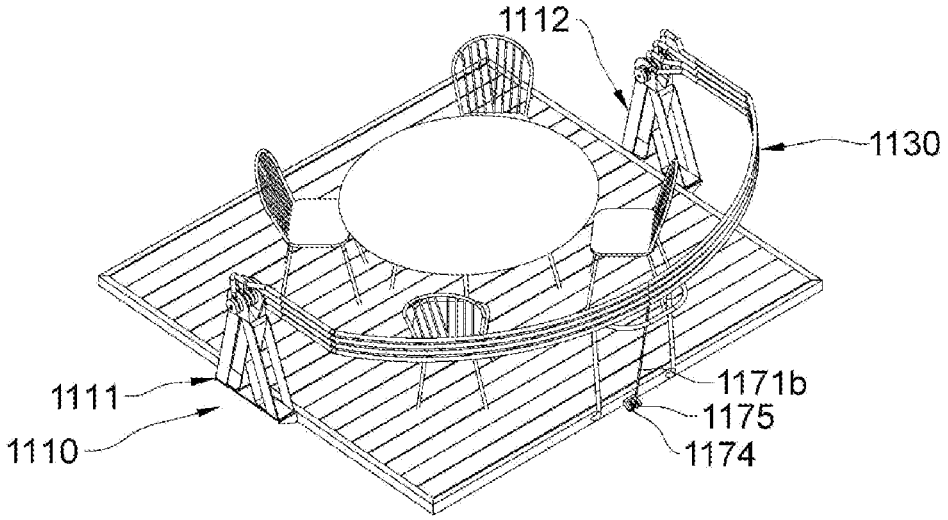
FIG. 21 is a single-view drawing showing a folded state of an angle variable multi-stage sunshade device according to a preferred embodiment of the present invention.
Figure 22:
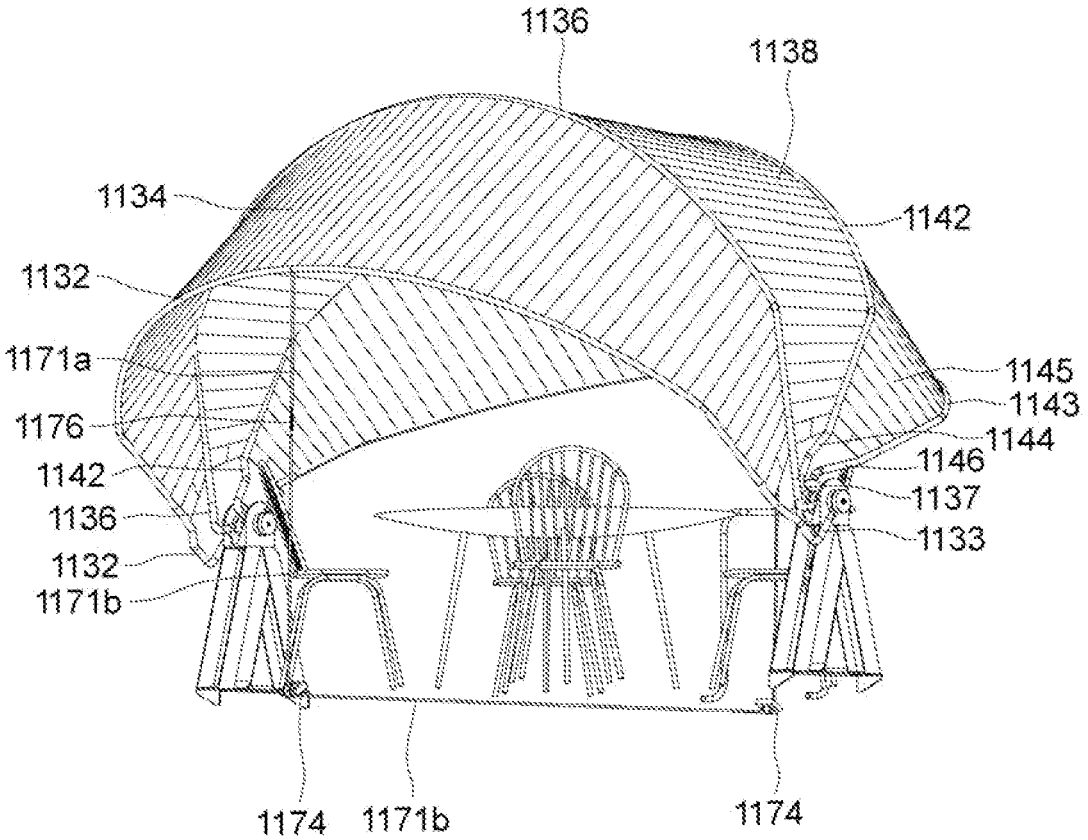
FIG. 22 is a single-view drawing showing an unfolded state of an angle variable multi-stage sunshade device according to a preferred embodiment of the present invention.
Figure 23:
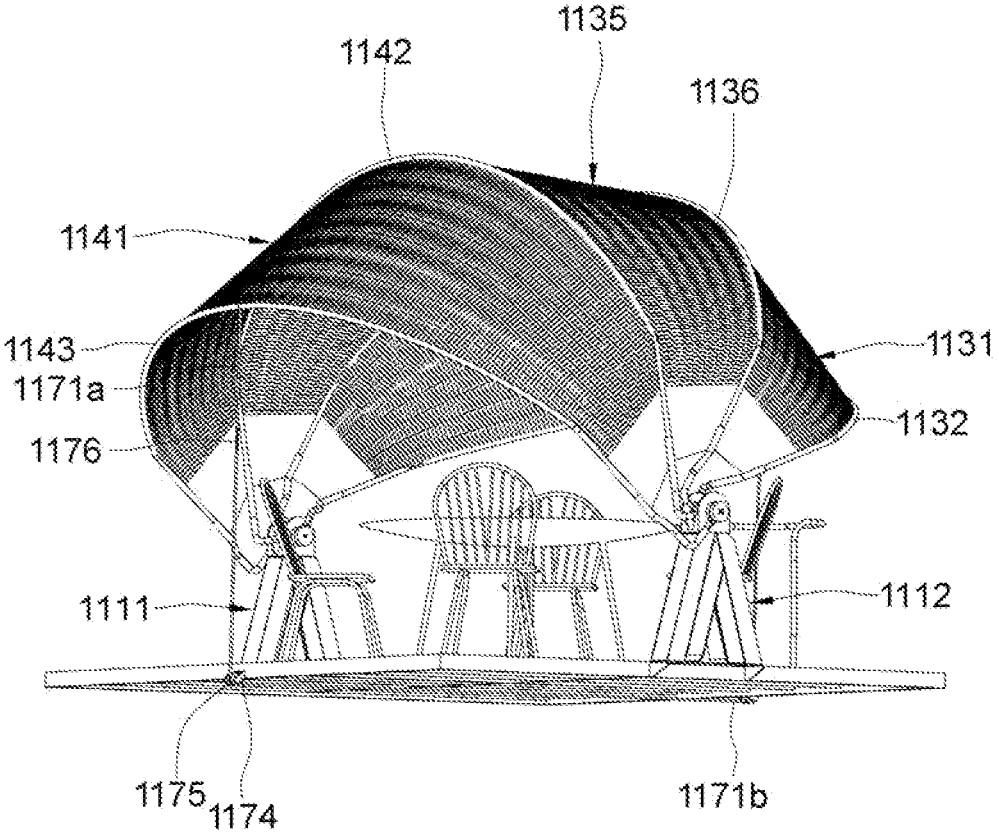
FIG. 23 is a single-view drawing showing a state in which an angle variable multi-stage sunshade device is installed according to a preferred embodiment of the present invention.
Figure 24:
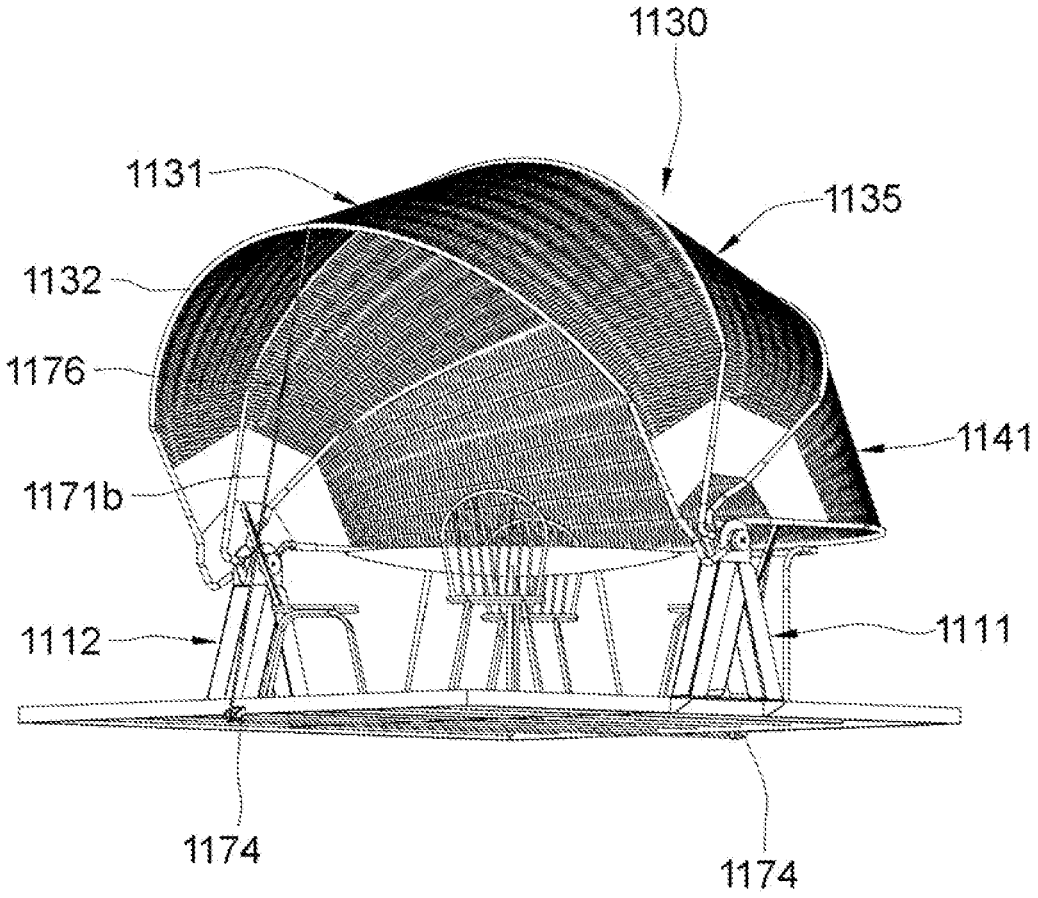
FIG. 24 is a single-view drawing showing a state in which an angle variable multi-stage sunshade device is tilted to one side according to a preferred embodiment of the present invention.

FIG. 21 is a single-view drawing showing a folded state of an angle variable multi-stage sunshade device according to a preferred embodiment of the present invention, FIG. 22 is a single-view drawing showing an unfolded state of an angle variable multi-stage sunshade device according to a preferred embodiment of the present invention, FIG. 23 is a single-view drawing showing a state in which an angle variable multi-stage sunshade device is installed according to a preferred embodiment of the present invention, and FIG.

24 is a single-view drawing showing a state in which an angle variable multi-stage sunshade device is tilted to one side according to a preferred embodiment of the present invention.

As shown in FIG. 21 to FIG. 24, the sunshade member (1130) releases the long wire (171*b*) of the 1st wire (1171) connected to the length control member (1176), allowing to fold the sunshade member (1130) conveniently.

When the long wire (171*a*) is released from the length control member (1176), the 1st sunshade unit (1131), the 2nd sunshade unit (1135), and the 3rd sunshade unit (1141) of the sunshade member (1130) can freely turn around the rotary bracket (1114) so that the 1st sunshade unit (1131) to the 3rd sunshade unit (1141) can be sequentially folded.

As described above, the invention made by the present inventor has been described in detail according to the above embodiments, but the present invention is not limited to the above embodiments and can be changed in various ways without departing from the gist thereof.

[Description of Signs]

| | |
|---|---|
| 100: rotary sunshade device | 110: base member |
| 111: frame | 120: support member |
| 121: 1st support | 122: 2nd support |
| 123: roller base | 124: roller frame |
| 125: roller | 126: horizontal frame |
| 127: 1st vertical frame | 128: 2nd vertical frame |
| 129: geared motor | 129A: electric motor |
| 129B: reduction gear device | 130: baseplate member |
| 140: rotary frame member | 141: circular frame |
| 142: bent frame | 143: fixing part |
| 150: rotary support member | 151: 1st rotary bracket |
| 152: 2nd rotary bracket | 160: sunshade member |
| 161: 1st sunshade | 162: 2nd sunshade |
| 163: 3rd sunshade | 164: 1st rotary frame |
| 165: 2nd rotary frame | 165a: 2nd-1 rotary frame |
| 165b: 2nd-2 rotary frame | 166: 3rd rotary frame |
| 166a: 3rd-1 rotary frame | 166b: 3rd-2 rotary frame |
| 167: 4th rotary frame | 170: deployment control member |
| 171: turnbuckle | 172: 1st wire |
| 173: 2nd wire | 174: 3rd wire |
| 180: fence member | |
| 1110: support member | 1111: 1st support |
| 1112: 2nd support | 1113: support |
| 1114: rotary bracket | |
| 1130: sunshade member | 1131: 1st sunshade unit |
| 1132: 1st sunshade frame | 1133: 1st rotary frame |
| 1134: 1st sunshade | 1135: 2nd sunshade unit |
| 1136: 2nd sunshade frame | 1137: 2nd rotary frame |
| 1138: 2nd sunshade | |
| 1141: 3rd sunshade unit | 1142: 3rd sunshade frame |
| 1143: 4th sunshade frame | 1144: 3rd rotary frame |
| 1145: 3rd sunshade | 1146: 4th rotary frame |
| 1170: deployment control member | 1171: 1st wire |
| 1172: 2nd wire | 1173: 3rd wire |
| 1174: fixing bracket | 1175: rotary roller |
| 1176: length control member | |

The invention claimed is:

1. An angle variable multi-stage sunshade device comprising:

a base member (110) with multiple frames (111) formed radially;

a support member (120) seated at an upper end of each of the multiple frames (111), and being either one of a first support (121) and a second support (122);

a baseplate member (130) installed on an upper surface of the first support (121), and formed in a flat plate shape;

a rotary frame member (140) installed on a side of the first support (121), and comprising a combination of a circular frame (141) formed in a circular ring shape, multiple bent frames (142), and multiple fixing parts (143);

a rotary support member (150) fixed to each of the multiple bent frames (142);

a sunshade member (160) rotatably installed on the rotary support member (150); and a deployment control member (170) installed to control the unfolding position of the sunshade member (160) and an interval at which the sunshade member is unfolded, wherein the rotary support member (150) may comprise:

a first rotary bracket (151) rotatably coupled to the sunshade member (160); and a second rotary bracket (152) rotatably coupled to the first rotary bracket (151).

2. The angle variable multi-stage sunshade device of claim 1, wherein the first support (121) comprises:

a roller base (123) provided in a truncated pyramid shape and attached at the upper end of some of the multiple frames (111);

a U-shaped roller frame (124) consisting of a horizontal frame (126) and first and second vertical frames (127, 128) that are provided vertically at both ends of the horizontal frame (126), wherein the first vertical frame (127) is coupled to an upper surface of the roller base (123); and a roller (125) provided in the space between the first vertical frame (127) and the second vertical frame (128), wherein the second support (122) comprises:

a roller frame (124) consisting of a horizontal frame (126) and first and second vertical frames (127, 128) that are provided vertically at both ends of the horizontal frame (126); and a roller (125) to be provided in the space between the first vertical frame (127) and the second vertical frame (128).

3. The angle variable multi-stage sunshade device of claim 1, wherein the sunshade member (160) comprises:

a first sunshade (161) formed in a radial arc shape to form a shading space;

a second sunshade (162) provided adjacent to the first sunshade (161), and formed in a radial arc shape to form a shading space;

a third sunshade (163) provided adjacent to the second sunshade (162), and formed in a radial arc shape to form a shading space;

a first rotary frame (164) rotatably coupled to the first rotary bracket (151), wherein the first rotary frame (164) fixes one end of the first sunshade (161);

a second rotary frame (165) rotatably coupled to the first rotary bracket (151), wherein the second rotary frame (165) fixes the other end of the first sunshade (161) and one end of the second sunshade (162);

a third rotary frame (166) rotatably coupled to the first rotary bracket (151), and wherein the third rotary frame (166) fixes the other end of the second sunshade (162) and one end of the third sunshade (163); and a fourth rotary frame (167) rotatably coupled to the first rotary bracket (151), wherein the fourth rotary frame (167) fixes the other end of the third sunshade (163).

4. The angle variable multi-stage sunshade device of claim 3, wherein the deployment control member (170) comprises:

a first wire (172) with one end fixed to the first rotary frame (164) and the other end fixed to a turnbuckle (171); and a second wire that passes through the multiple fixing parts (143), with one end fixed to the turnbuckle (171) and the other end fixed to the fourth rotary frame (167).

5. The angle variable multi-stage sunshade device of claim 1, further comprising a fence member (180) installed along the perimeter of the baseplate member (130).

6. An angle variable multi-stage sunshade device comprising:

a support member (1110) consisting of a first support (1111) installed on one side and a second support (1112) installed spaced apart from the first support (1111) by a predetermined distance;

a sunshade member (1130) comprising multiple sunshade units (1131, 1135, 1141) that are rotatably installed on the first support (1111) and the second support (1112), respectively; and a deployment control member (1170) installed to adjust the unfolding position and interval of the multiple sunshade units (1131, 1135, 1141), wherein the support member (1110) comprises:

a support (1113) formed at a predetermined height; and a rotary bracket (1114) installed on an upper surface of the support (1113), and to which the multiple sunshade units (1131, 1135, 1141) are rotatably coupled, wherein the sunshade member (1130) comprises:

a first sunshade unit (1131) rotatably coupled to the support member (1110), and formed in a radial arc shape to form a shading space;

a second sunshade unit (1135) rotatably coupled to the support member (1110), and formed in a radial arc shape to form a shading space; and a third sunshade unit (1141) rotatably coupled to the support member (1110), and formed in a radial arc shape to form a shading space, wherein a first sunshade frame (1132) for fixing one end of a first sunshade (1134) is fixed to the first sunshade unit (1131), a first rotary frame (1133) is rotatably coupled to the rotary bracket (1114), wherein the second sunshade unit (1135) comprises a second sunshade frame (1136), the second sunshade frame (1136) is fixed to one end of the first sunshade (1134) and one end of a second sunshade (1138), a second rotary frame (1137) is rotatably coupled to the rotary bracket (1114), wherein the third sunshade unit (1141) comprises a third sunshade frame (1142) and a fourth sunshade frame (1143) for fixing a third sunshade (1145), a third rotary frame (1144) is rotatably coupled to the rotary bracket (1114), a fourth rotary frame (1146) is rotatably coupled to the rotary bracket (1114), wherein the first rotary frame (1133), the second rotary frame (1137), the third rotary frame (1144) and the fourth rotary frame (1146) are coupled to the rotary bracket (1114) along an axis of the rotary bracket (1114).

7. The angle variable multi-stage sunshade device of claim 6, wherein the deployment control member (1170) comprises:

a first wire (1171) having one end fixed to the first sunshade unit (1131) and the other end fixed to the third sunshade unit (1141); and a wire guide (1175) installed on a fixing bracket (1174) installed on a lower side of the first sunshade unit (1131), wherein the first wire (1171) comprises:

a short wire (1171*a*) a having one end connected to the first sunshade frame (1132) of the first sunshade unit (1131) and the other end connected to a length control member (1176); and a long wire (1171*b*) having one end connected to the length control member (1176) and the other end connected to the fourth sunshade frame (1143) of the third sunshade unit (1141) via the wire guide (1175).

* * * * *